US005915479A

United States Patent [19]

Ponte

[11] Patent Number: 5,915,479

[45] Date of Patent: Jun. 29, 1999

[54] VELO SPRINKLER ARRANGEMENT FOR PROTECTING SPECIAL OCCUPANCY HAZARDS

[75] Inventor: Gary W. Ponte, Livingston, N.J.

[73] Assignee: The Reliable Automatic Sprinkler, Mount Vernon, N.Y.

[21] Appl. No.: 08/873,675

[22] Filed: Jun. 12, 1997

[51] Int. Cl.[6] ..... A62C 2/00

[52] U.S. Cl. ..... 169/46; 169/37; 169/16

[58] Field of Search ..... 239/208, 209, 239/266, 498; 169/16, 37, 46

[56] References Cited

U.S. PATENT DOCUMENTS

| | | | |
|---|---|---|---|
| 316,581 | 4/1885 | Stratton . | |
| 466,658 | 1/1892 | Cumnock et al. . | |
| 550,968 | 12/1895 | Hart . | |
| 1,028,940 | 6/1912 | Hunter . | |
| 1,885,219 | 11/1932 | Bills et al. . | |
| 3,698,482 | 10/1972 | Livingston | 169/16 |
| 3,743,022 | 7/1973 | Livingston | 169/16 |
| 4,099,675 | 7/1978 | Wohler et al. . | |
| 4,280,562 | 7/1981 | Glinecke . | |
| 4,700,893 | 10/1987 | Bugler, III . | |
| 4,800,961 | 1/1989 | Klein | 169/37 |
| 5,366,022 | 11/1994 | Meyer et al. . | |
| 5,579,846 | 12/1996 | Meyer et al. . | |
| 5,609,211 | 3/1997 | Meyer et al. | 169/16 X |
| 5,687,914 | 11/1997 | Bosio et al. . | |
| 5,829,532 | 11/1998 | Meyer et al. | 169/37 |

OTHER PUBLICATIONS

*Installation of Sprinkler Systems,* NFPA 13, 1994 Edition National Fire Protection Association, Feb. 11, 1994.

NFPA 30 "Container and Portable Tank Storage", pp. 30–39 to 3048, 1996 Edition.

NFPA 30B, "Manufacture and Storage of Aerosol Products" pp. 30B–10 to 30B–18, 1994 Edition.

NFPA 231, "Standard for General Storage" pp. 231–1 to 231–18, 1995 Edition.

NFPA 231C "Rack Storage", Aug. 1995, pp. 231C–1 to 231C–52.

NFPA 231D, "Standard for Storage of Rubber Tires" pp. 231D–1 to 231D–17, 1994 Edition.

NFPA 231F "Standard for the Storage of Roll Paper", pp. 231F–1 to 231F–14, 1996 Edition.

NFPA 232 "Records Protection Equipment", pp. 232–239, 1995 Edition.

*Primary Examiner*—Andres Kashnikow
*Assistant Examiner*—Steven J. Ganey
*Attorney, Agent, or Firm*—Baker & Botts, LLP

[57] ABSTRACT

In the typical sprinkler arrangements described in the specification, effective protection for certain special occupancy hazards is achieved with a low pressure water supply using VELO sprinklers having a K factor of at least 14 arranged in arrays in which the sprinklers are spaced by ten feet in two orthogonal directions or by ten feet in one direction and by eight feet in an orthogonal direction. The commodities to be protected are stored in racks extending parallel to one of the orthogonal directions. For most hazards, a water pressure of 7 psi (0.5 bar) is effective with sprinklers having a K factor of 14. For plastic materials, a water pressure of 12 psi (0.8 bar) is effective for sprinklers having a K factor of 14 and, using sprinklers having a higher K factor, the pressure can be reduced to 7 psi (0.5 bar).

66 Claims, 22 Drawing Sheets

VELO SPRINKLER ARRANGEMENT FOR PROTECTING SPECIAL OCCUPANCY HAZARDS

BACKGROUND OF THE INVENTION

This invention relates to fire protection sprinkler arrangements and, more particularly, to sprinkler arrangements utilizing very extra large orifice sprinklers, which are capable of operating at relatively low water pressure to provide protection for certain special occupancy hazards as described herein.

For many years, the National Fire Protection Association (NFPA) has promulgated and maintained standards which are relied upon by local authorities in approving the design of proposed fire protection systems. Among those standards are the Flammable and Combustible Liquids Code NFPA 30, the Manufacture and Storage of Aerosol Products Code NFPA 30B, the General Storage Standard NFPA 231, which relates to the storage of many commodities including Class I, Class II, Class III and Class IV commodities representing a broad range of materials including Group A, Group B and Group C plastics that are stored palletized or stored in slatted wooden crates, solid wooden boxes, multi-wall corrugated cartons or equivalent combustible packaging materials or wooden pallets, Rack Storage Standard NFPA 231C which relates to protection of a broad range of commodities including plastics stored in racks, Rubber Tire Storage Standard NFPA 231D, which relates to indoor storage of rubber tires, Roll Paper Storage Standard NFPA 231F which relates to storage of roll paper, and the protection of Records Standard NFPA 232. As used herein, the commodities and storage conditions described in those standards are called "special occupancy hazards".

Because of the difficulty in protecting special occupancy hazards of the type described in the above cited NFPA standards, each of those standards has heretofore specified a minimum design water pressure of 10 psi (0.7 bar) and has required the use of sprinklers having a maximum orifice diameter of ⅝ inch (15.9 mm.) for sprinkler systems designed to protect such hazards. In some cases these requirements apply to storage height exceeding 12 feet.

Such sprinklers have a nominal K factor of 11, where the K factor represents the rate of water flow through the sprinkler in gallons per minute divided by the square root of the water pressure applied to the sprinkler in pounds per square inch. In this regard, it is desirable to provide sprinkler arrangements for such special occupancy hazard having a higher K factor since lower pressures can then be utilized.

It has been universally believed and accepted throughout the industry, however, that lower design pressures, below 10 psi (0.7 bar), or larger sprinkler orifices (higher K factor) could not provide adequate protection for special occupancy hazards of the type to which those standards are directed. In many instances, such sprinkler size and system pressure requirements impose undue limitations on the design and construction of fire prevention sprinkler systems and result in increased construction costs.

SUMMARY OF THE INVENTION

Accordingly, it is an object of the present invention to provide a sprinkler arrangement for protecting special occupancy hazards which overcomes disadvantages of the prior art.

Another object of the invention is to provide a new and improved sprinkler arrangement which is effective to provide protection for special occupancy hazards at reduced design and construction costs.

A further object of the invention is to provide a fire protection sprinkler arrangement having a K factor of 14 or more which is effective to provide desired protection for special occupancy hazards at design pressures less than 10 psi (0.7 bar) and as low as 7 psi (0.5 bar).

These and other objects of the invention are attained by providing a sprinkler arrangement utilizing sprinklers which have a sprinkler body adapted to be connected to a source of water under pressure and including a passage for directing water under pressure through the sprinkler body and a deflector arranged to deflect water supplied through the passage over the area to be protected, in which the orifice of the sprinkler passage has a diameter of at least ¾ inch (19 mm.) or more, providing a nominal K factor of at least 14. Surprisingly, such sprinklers, which are known in the industry as very extra large orifice (VELO) sprinklers have now been shown to assure adequate water distribution and density when water is supplied at pressures as low as 7 psi (0.5 bar) to protect special occupancy hazards as defined herein. This ability to provide improved protection for special occupancy hazards at low design pressures and high K factors is even more surprising because authorities in the field of fire protection have uniformly contended that VELO sprinklers having K factors greater than 11 and operating at pressures below 10 psi (0.7 bar) would not be successful in providing the required protection for such commodities.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
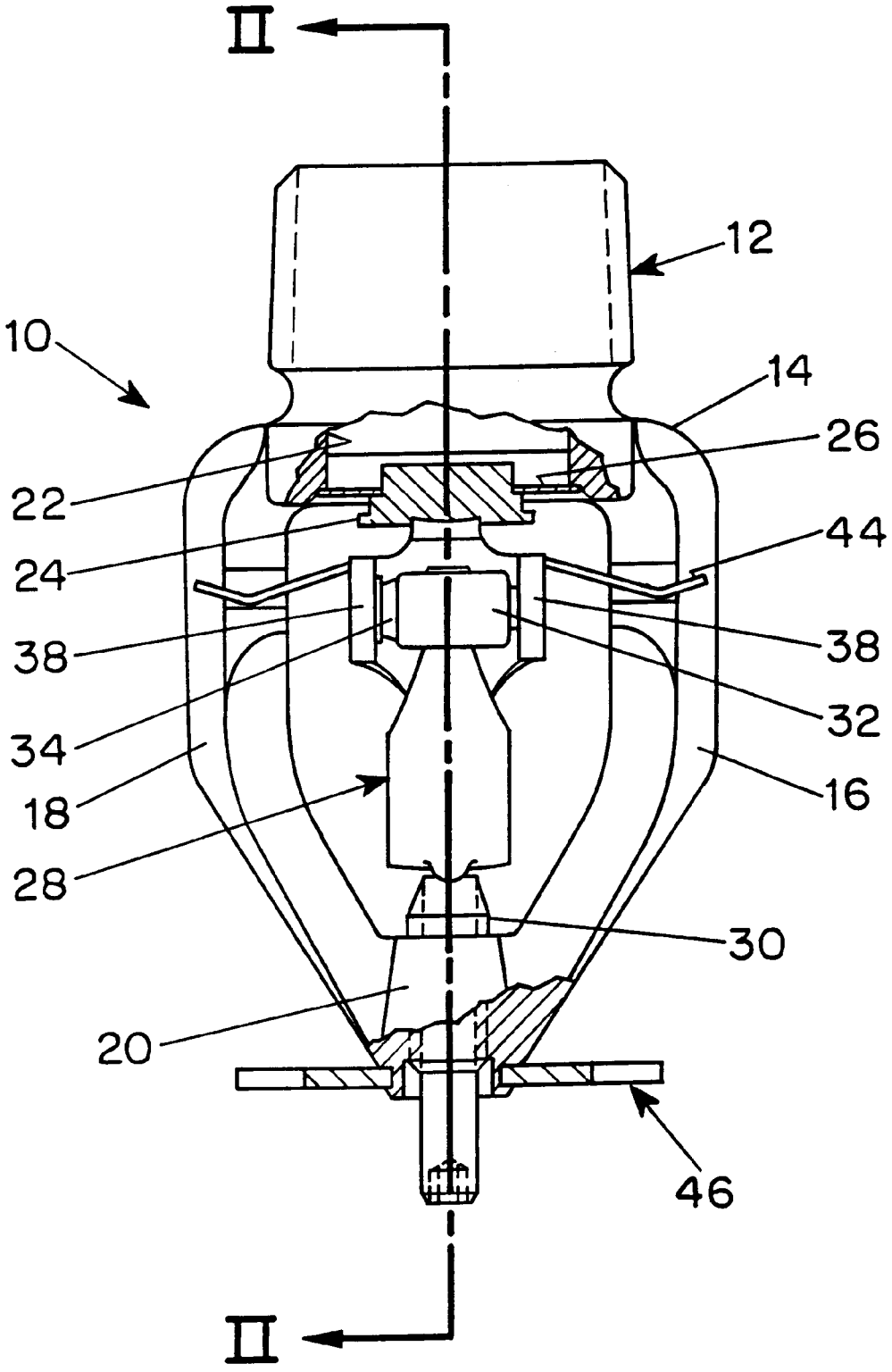
FIG. 1 is a side view, partly in section, illustrating a representative embodiment of a VELO sprinkler of the type used for protection of special occupancy hazards in accordance with the invention.
Figure 2:
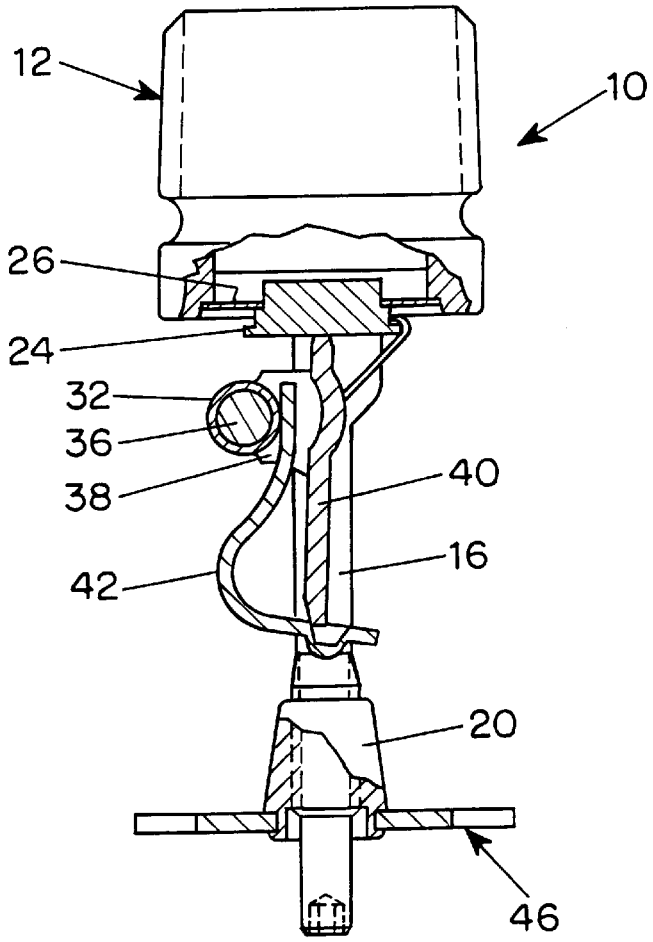
FIG. 2 is a cross-sectional view taken on the line II—II of FIG. 1 and looking in the direction of the arrows.
Figure 3:
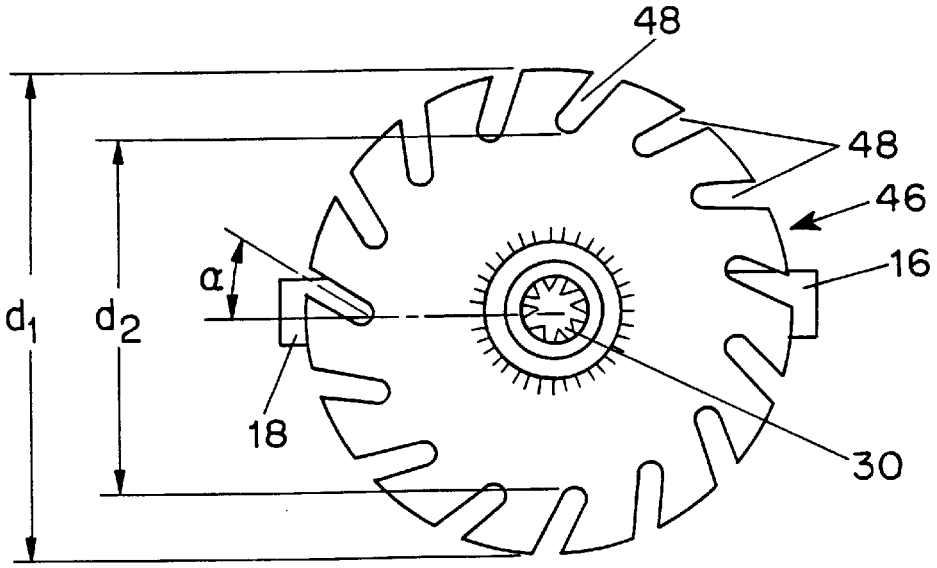
FIG. 3 is an end view of the sprinkler shown in FIGS. 1 and 2.

In the typical embodiments of the invention described herein and shown in the drawings, an array of very extra large orifices (VELO) sprinklers 10 of the type shown, for example, in FIGS. 1–3 is mounted above a region containing Class II commodities to be protected with each sprinkler positioned to protect an area of no more than 100 square feet. A typical sprinkler array is shown, for example, in FIG. 4 in which the sprinklers 10 are spaced at ten foot intervals in mutually orthogonal directions. Each of the sprinklers 10 is preferably of the same general type as described in the Ponte Application Serial No. 08/790,162 filed Jan. 28, 1997, the disclosure of which is incorporated herein by reference, having an orifice diameter of about ¾ inch (19 mm.) providing a K factor of 14. These sprinklers may be arranged, for example, to distribute water over an area of about 100 sq. feet to be protected at a rate of at least 0.37 gpm/ft$^2$ at a water pressure of 7 psi (0.5 bar) and over an area of about 80 sq. feet at a rate of at least 0.6 gpm/ft$^2$ at a pressure of 12 psi (0.7 bar). Different water distribution densities may be provided for various storage arrangements in accordance with the above-cited NFPA Standards. Other designs of VELO sprinklers may be used, if desired, provided that they are capable of producing the required water density and distribution for the particular application.

In particular, sprinklers having a higher K factor such as 17, 22 and 25, providing flow rates of 45, 58 and 66 gpm, respectively, at 7 psi (0.5 bar) may be used. With such sprinklers spaced at ten feet by ten feet, densities of 0.45, 0.58 and 0.66 gallons per square foot per minute are obtained with 7 psi (0.5 bar) pressure. At spacings of 8 feet by 10 feet, densities of 0.56, 0.72 and 0.825 gallons per square feet per minute are provided at 7 psi (0.5 bar) pressure.

The typical VELO sprinkler 10 shown in FIGS. 1–3 has a threaded end 12 adapted to be connected to a pipe arranged to supply water under pressure and a frame 14 consisting of two arms 16 and 18 extending from opposite sides of the threaded end 12 and joined at a boss 20 which is positioned on the sprinkler axis and spaced from the threaded end 12. The threaded end 12 is formed with an axial internal passage 22 to direct a stream of water under pressure axially toward the boss 20 and is normally closed by a cap 24 fitted in a washer 26 which is seated on a shoulder at the end of the passage 22. The sealing cap 24 is retained in its passage-closing position by a conventional thermally responsive arrangement 28 which extends between the cap 24 and a screw 30 threaded through the boss 20.

In the illustrated embodiment, the thermally responsive arrangement 28 includes a cylinder 32 containing a ball 34 at one end which is held in position by a block 36 of solder arranged to be fused at a selected elevated temperature such as 165° F. (74° C.). In the unfused condition illustrated in FIGS. 1 and 2 the cylinder 32 is retained between projecting arms 38 on a strut member 40 to restrain a lever member 42 in a strut-supporting position so as to hold the cap 24 and its associated washer 26 in passage-closing position. When the eutectic material fuses in response to an elevated temperature, the cylinder 32 is released from the arms 38 of the strut 40, permitting the lever 42 to pivot outwardly, thereby releasing the strut from its cap-supporting position. If desired, the thermally responsive fusible element 36 may be fusible at another temperature, such as 212° F. (100° C.) or 286° F. (141° C.). Alternatively, any other conventional temperature-responsive arrangement, such as a glass bulb operable at, for example, 155° F. (68° C.), 175° F. (79° C.) or 200° F. (93° C.), may be substituted for the temperature-responsive arrangement 28.

To facilitate removal of the strut and lever assembly from the path of water emerging from the passage 22 a spring 44 extending between the frame arms 16 and 18 engages the strut 40. The water projected axially through the passage 22 is therefore directed along an unimpeded path toward a deflector 46 which is mounted on the boss 20 and is arranged to divert the water radially outwardly so as to be dispersed over the region to be protected. If desired, the cap 24 may be asymmetrically shaped so as to be deflected laterally by the emerging water stream. In this case, the spring 44 may be omitted. Moreover, for deluge-type applications, the flow of water through the sprinkler may be controlled by a remote valve in the water supply line rather than a thermally responsive arrangement in the sprinkler.

In the illustrated embodiment, the deflector 46 has a planar configuration and, as best seen in FIG. 3, to facilitate an increased density of water distribution over the area to be protected, the deflector is provided with a circumferential array of slots 48 which extend inwardly from the periphery of the deflector at an angle α to a radial line extending through the inner end of the slot as shown in FIG. 3. Preferably, the angle α is within the range from about 20° to about 50°, desirably about 30° to about 40°, and most desirably about 35°.

In a preferred embodiment arranged for maximum water density distribution over a protected area up to about 10 feet by 10 feet and located from about 1 foot, 6 inches to about 10 feet below the sprinkler, the deflector 46 has a diameter $d_1$ in the range from about 1.10 inches to about 1.20 inches and preferably about 1.15 inches. The root diameter $d_2$ at the inner ends of the slots 48 is preferably about 0.6 inch to about 1.0 inch, desirably about 0.7 inch to about 0.9 inch and most desirably about 0.85 inch. In this embodiment there are 15 slots spaced uniformly in the circumferential direction but a larger or smaller number of slots may be used. Each slot preferably has a width of about 0.04 inch to about 0.08 inch.

By using such angularly oriented slots, some of the water from the axial passage 22 is permitted to pass through the deflector 46 over substantially the entire circumferential peripheral area of the deflector, rather than only at selected angular positions, providing more uniform water distribution. As a result, more water is supplied to the threatened region in the same time period and the water is supplied more uniformly over the region, thereby improving the ability to contain a fire within its initial ignition location and to extinguish the fire which has already been ignited. Thus, a deflector arrangement having slots disposed at an angle to a radial line has been found to provide increased water density, in gallons per square foot per minute, and more uniform distribution in the area to be protected, in comparison with a sprinkler having the same number of slots of the same width and the same root diameter but oriented along a radial line.

In accordance with the present invention, moreover, the diameter of the axial internal passage 22 is at least ¾ inch (19 mm) (K=14). If the pressure of the water supplied from the water line through the passage 22 is 7 psi (0.5 bar) this provides a water density of at least 0.37 gallons per minute per square foot over an area to be protected which is ten feet by ten feet approximately ten feet below the sprinkler. If the water is supplied at a pressure of 12 psi (0.8 bar) this provides a water density of at least 0.6 gallons per minute per square foot over an area to be protected which is ten feet by eight feet approximately ten feet below the sprinkler.

With this arrangement, it has been found surprisingly that special occupancy hazards are adequately protected when commodities are stored in the manner specified in the relevant NFPA Standard. Thus, despite the beliefs of those in the industry to the contrary, in accordance with the invention VELO sprinklers supplied with water at pressures as low as 7 psi (0.5 bar) are capable of protecting special occupancy hazards.

Moreover, the tests carried out with such sprinkler arrangements, as described in the Examples below, demonstrate that sprinklers having a higher K factor, such as 17, 22 or 24 will also be effective to provide the required protection for special occupancy hazards.

The following examples demonstrate the effectiveness of sprinklers of the present invention in accordance with the NFPA standards.

EXAMPLE 1

Figure 4:
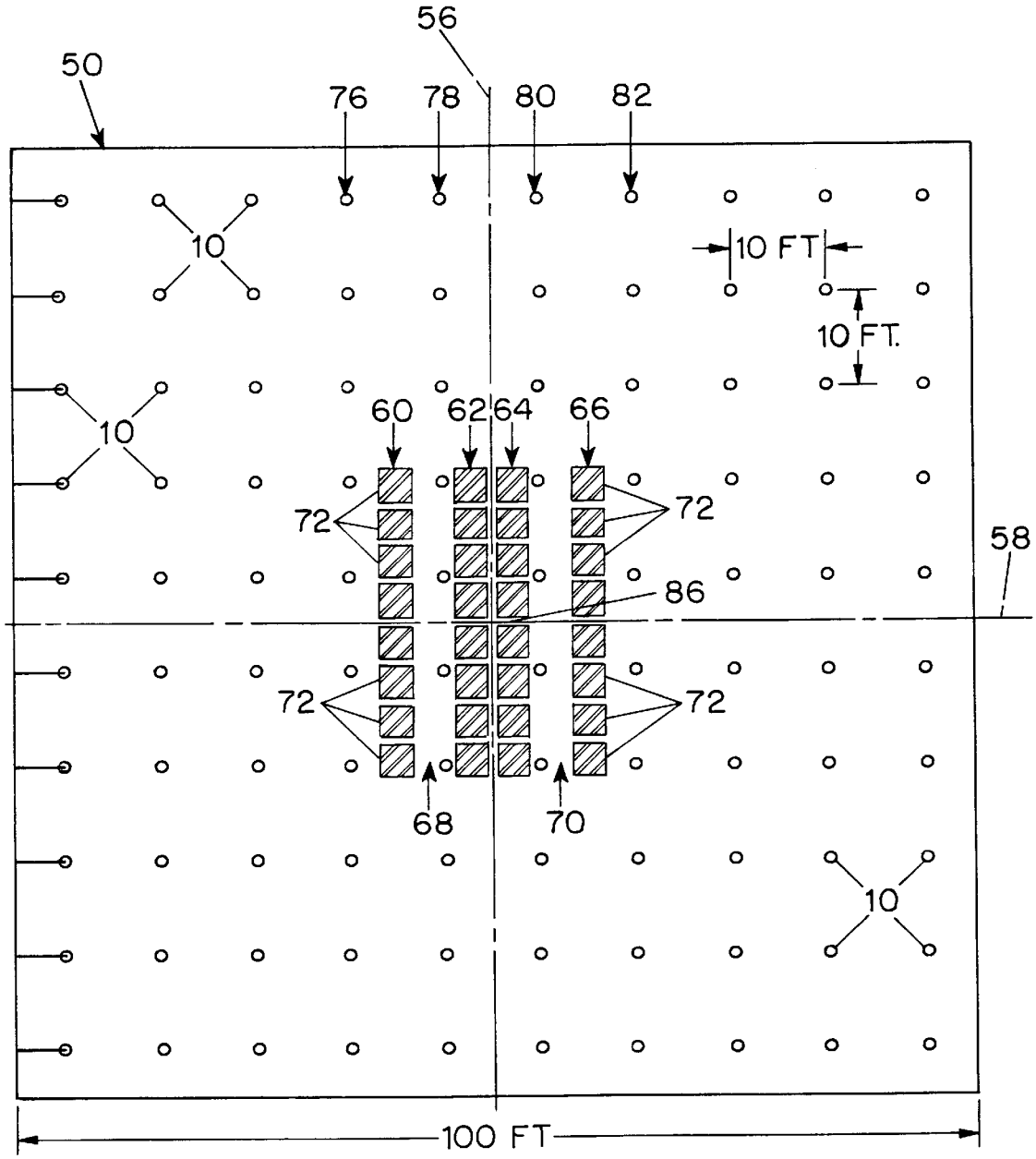
FIG. 4 is a plan view illustrating the arrangement of sprinklers for representative special occupancy hazards in a first example of the sprinkler arrangement of the present invention.
Figure 5:
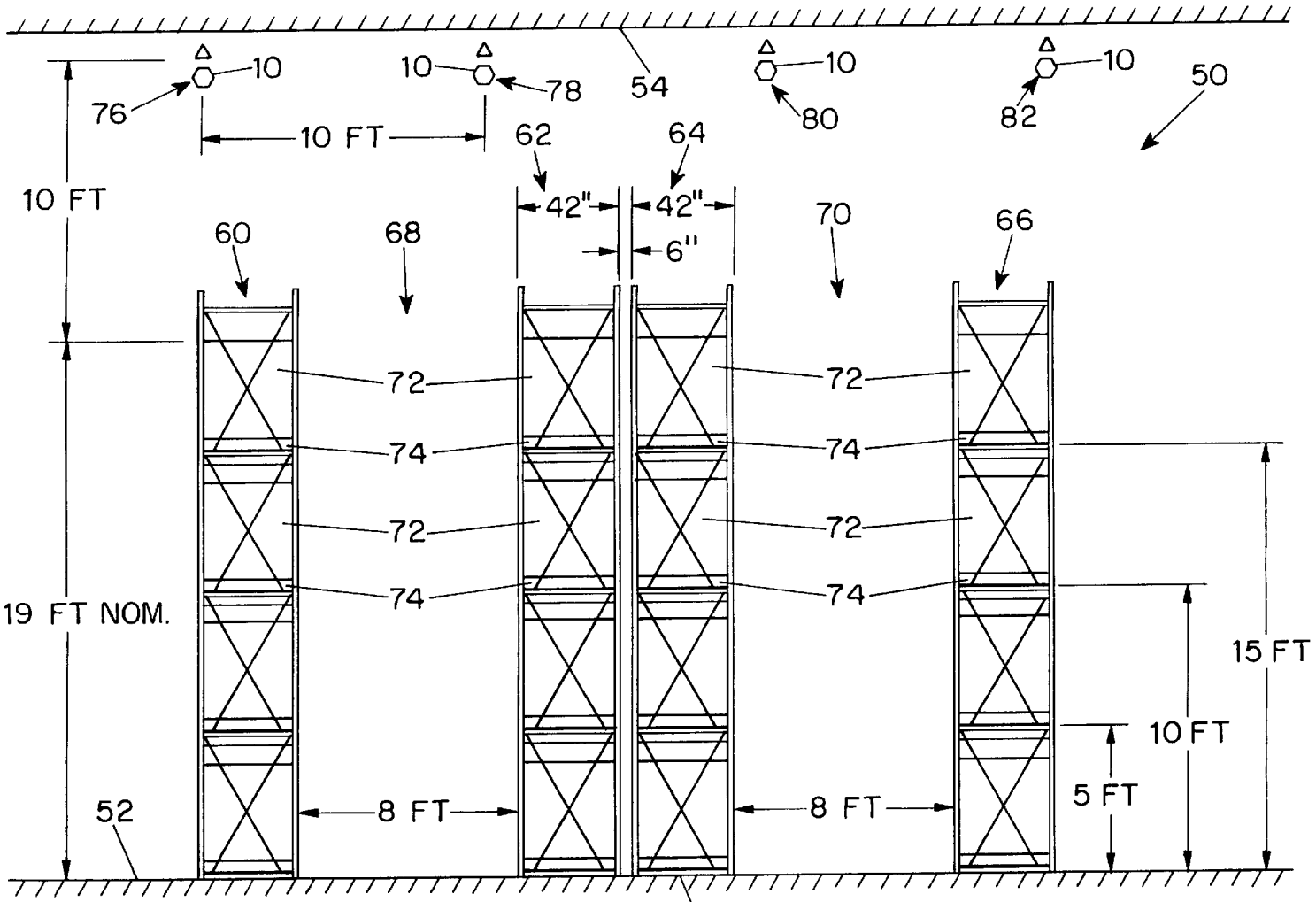
FIG. 5 is an end view of the arrangement of stored commodities shown in FIG. 4.
Figure 6:
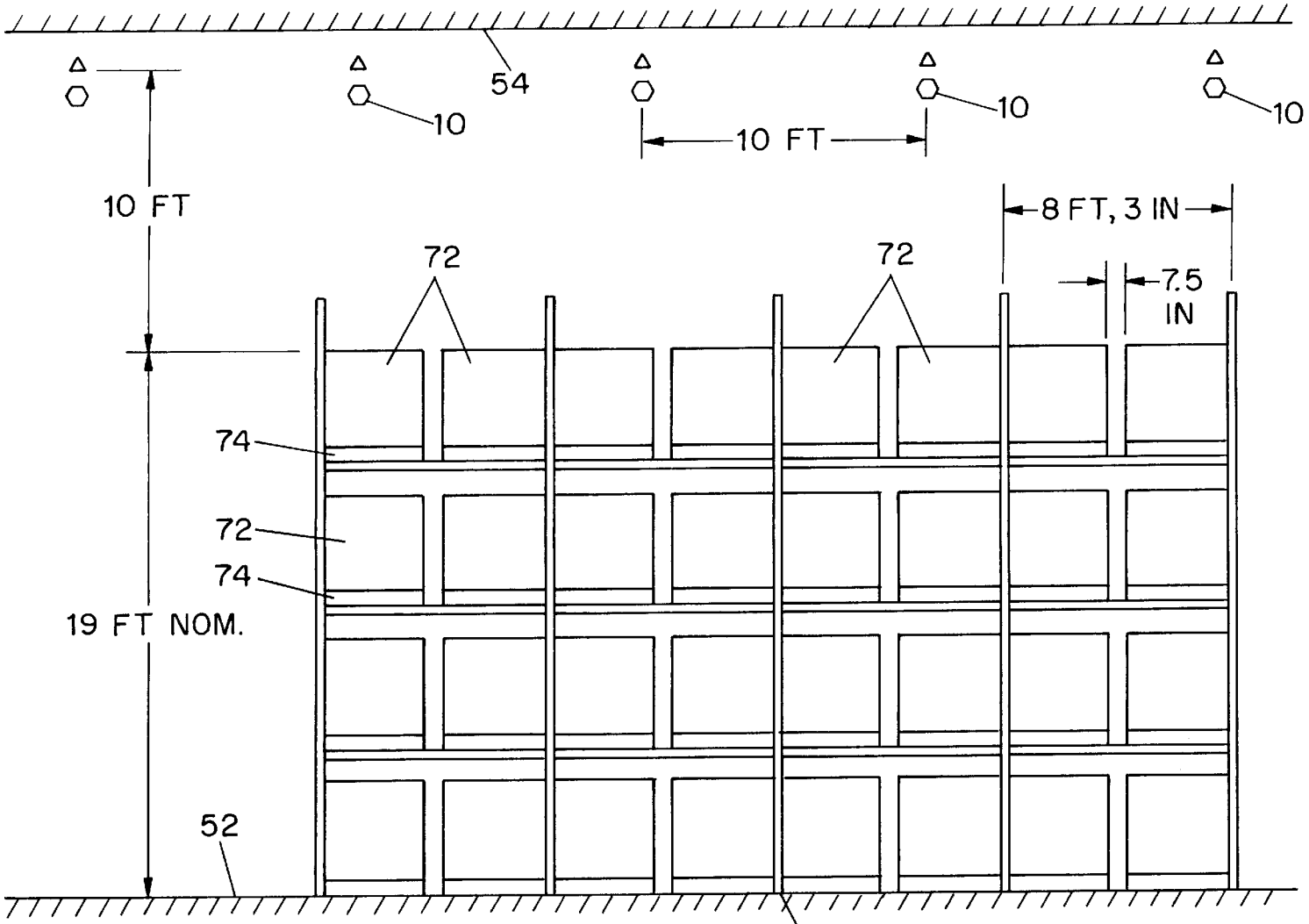
FIG. 6 is a side view of the arrangement of stored commodities shown in FIG. 4.

In this example an array of pendent sprinklers 10 of the type described above was positioned in a test room 50 with a floor 52 and a ceiling 54 having dimensions of 100 feet by 100 feet by 30 feet high and orthogonal center lines 56 and 58 with the sprinklers 10 spaced at ten foot intervals in mutually orthogonal directions as depicted in FIGS. 4–6, the sprinklers being located approximately 29 feet above the floor 52 as shown in FIGS. 5 and 6. The sprinklers 10 had an activation temperature of 165° F. (74° C.) and were connected to a water supply line having an operating pressure of 7 psi (0.5 bar).

Four racks 60, 62, 64 and 66 were positioned symmetrically about the orthogonal center lines 56 and 58 of the room with the racks extending parallel to each other in the direction of the center line 56 under four adjacent rows of sprinklers 76, 78, 80 and 82. Two centrally disposed racks 62 and 64 were located between two adjacent rows of sprinklers 78 and 80 with a six inch spacing between the racks. The other racks 60 and 66 were spaced on opposite sides of the rows 62 and 64 by eight foot aisles 68 and 70.

In this example, 128 double tri-wall corrugated cardboard cartons 72 measuring 42 inches by 42 inches by 42 inches and having steel stiffeners inserted for stability were mounted on 42 inch by 42 inch by 5 inch high hardwood pallets 74. The pallets were installed in eight adjacent columns four pallets high in each rack with the top approximately ten feet below the sprinklers as shown in FIG. 6. The racks 60, 62, 64 and 66 were positioned between the rows 76, 78, 80 and 82 of sprinklers as shown in FIG. 4, so that the rows of sprinklers 78 and 80 extended along the aisles 68 and 70 adjacent to the outwardly facing sides of the racks 62 and 64 respectively. An ignition point 86 was positioned at the floor 52 between the fourth and fifth pallets of the rack 64 from one end as shown in FIGS. 4–6. Ignition was effected at that point by using four standard cellulose cotton igniters.

Figure 7:
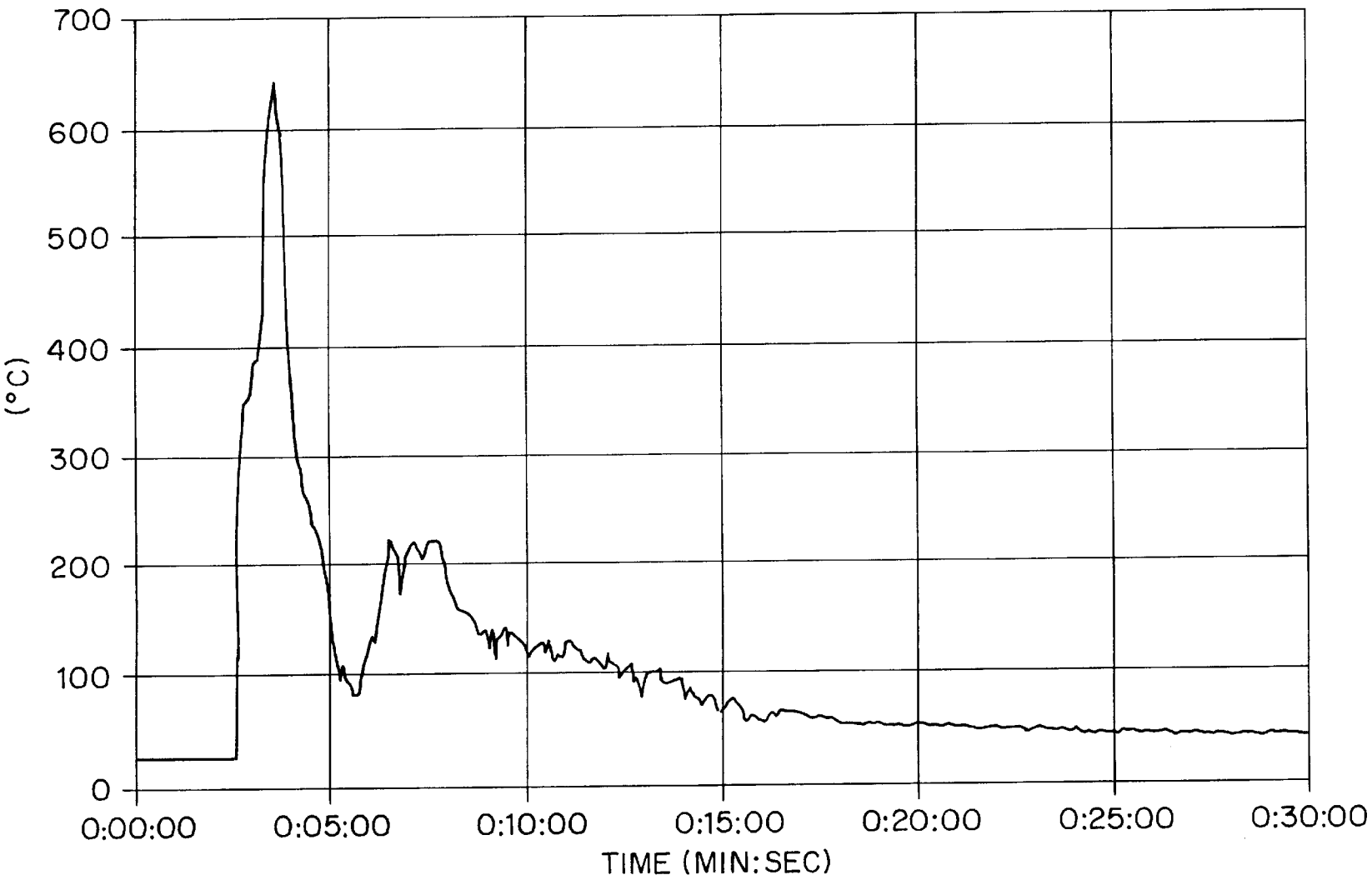
FIG. 7 is a graphical illustration showing the change of temperature with respect to time above the point of ignition during test of the arrangement in the first example.

FIG. 7 illustrates the change in air temperature at a location six inches below the ceiling 54 directly above the ignition location. During this test, the four sprinklers above the side of the rack 62 in the row of sprinklers 78 were activated between about 3½ and 4 minutes after initiation of ignition and three of the sprinklers in the row 80 above the side of the rack 64 were activated in just under four minutes after ignition at the time of maximum air temperature shown in FIG. 7. As shown in that graphical illustration, the air temperature at the ceiling immediately began dropping and decreased to less than 100° C. within about 1½ minutes and, following a slight increase to 200° C. during the next two minutes, decreased to less than 50° C. indicating completing extinction of the fire.

Figure 8:
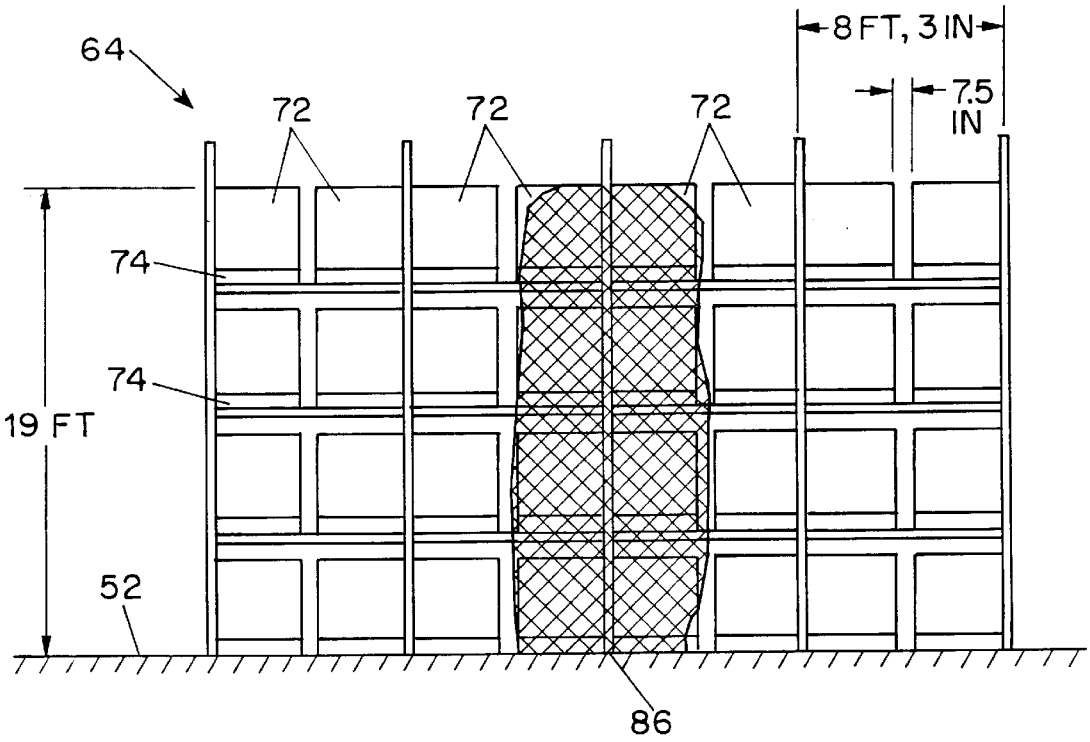
FIG. 8 is a side view of the center portion of the arrangement shown in FIG. 4 indicating the extent of fire damage.
Figure 9:
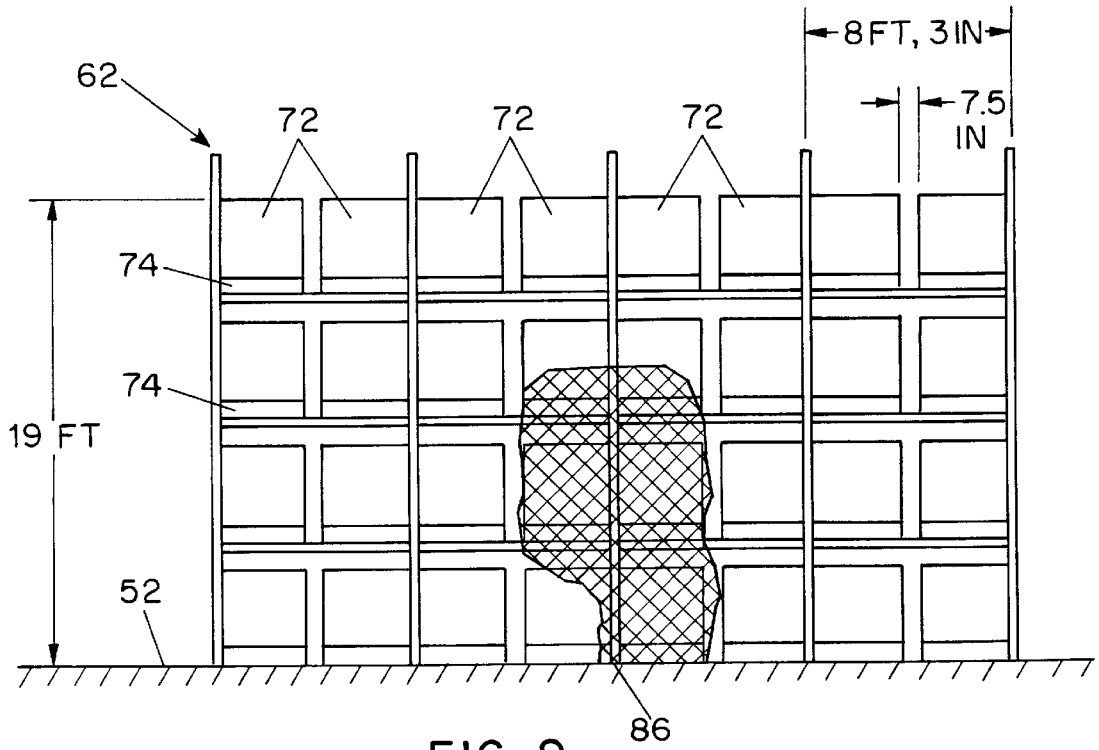
FIG. 9 is a side view from the other side of the center portion of the arrangement shown in FIG. 4 indicating the extent of fire damage.

FIG. 8 is a view of the side of the rack 64 under which the fire was ignited indicating the extent of fire damage in that rack in cross-hatched lines and FIG. 9 is a view of the side of the rack 62 showing the extent of fire damage in that rack. As shown in those figures, only eight pallets in the rack 64 and only six pallets in the row 62 sustained fire damage in this test. None of the commodities stored in the racks 60 and 66 sustained any damage. The total quantity of material consumed by fire in this test was about three pallets. Thus, this example shows that an array of the VELO sprinklers supplied with water at the pressure of 7 psi (0.5 bar) is capable of containing a fire in an array of racks of Class II combustible material in an efficient an effective manner.

EXAMPLE 2

Figure 10:
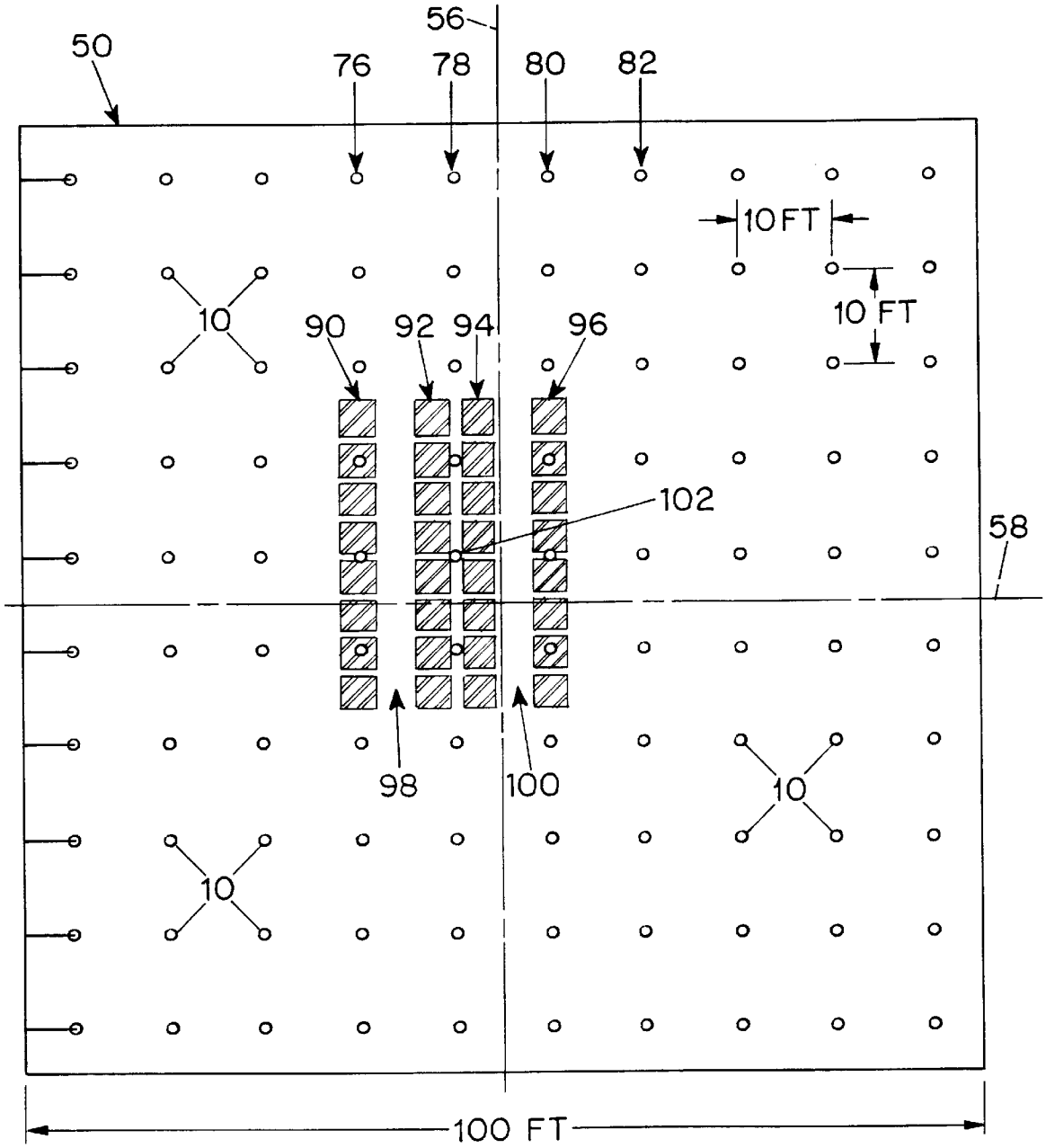
FIG. 10 is a plan view illustrating an arrangement of sprinklers for representative special occupancy hazards in a second example of the present invention.

In this example four racks 90, 92, 94 and 96 identical to those described above in connection with the first example and containing the same type of cartons 72 on pallets 74 were positioned in the manner shown in FIG. 10, with one rack 90 located beneath the row 76 of sprinklers and positioned so that one sprinkler was located directly above the center of the rack and two other sprinklers spaced above the second and seventh pallet columns in the rack. The racks 92 and 94 were positioned so that the row of sprinklers 78 extended over the six-inch space between the racks, the rack 96 being positioned beneath the row of sprinklers 80 in the same manner as the rack 90 beneath the sprinkler 76. An eight foot aisle 98 was provided between the racks 90 and 92 and a similar aisle 100 was provided between the racks 94 and 96. The pallets contained the same type of Class II test commodity and the sprinklers had the same water pressure as in the first example. In this case, an ignition point 102 was located on the floor in the space between the two racks 92 and 94 and between the fourth and fifth columns of pallets in each of those racks as shown in FIG. 10.

Figure 11:
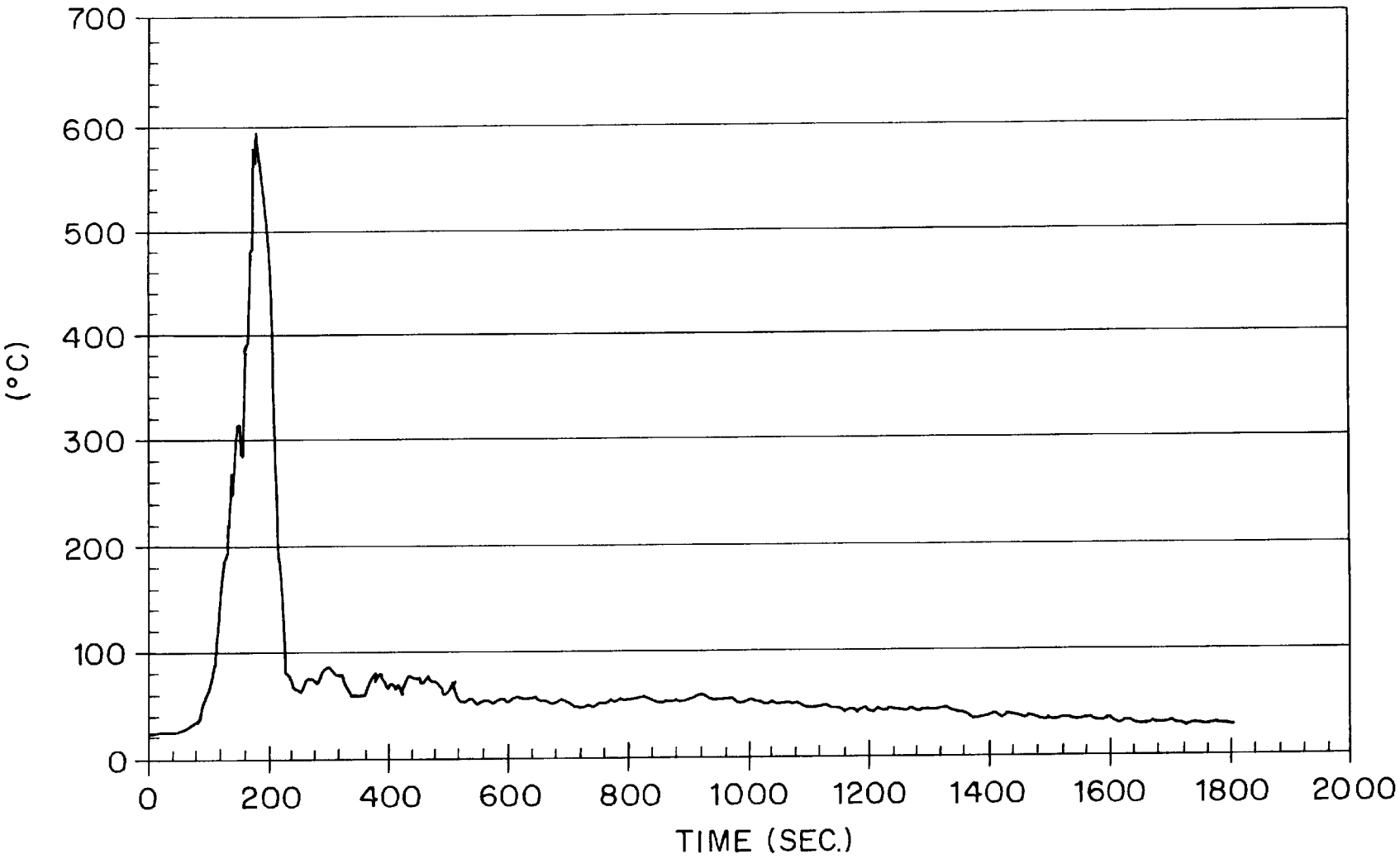
FIG. 11 is a graphical illustration showing the change in temperature with time above the point of ignition during a test of the second example.
Figure 12:
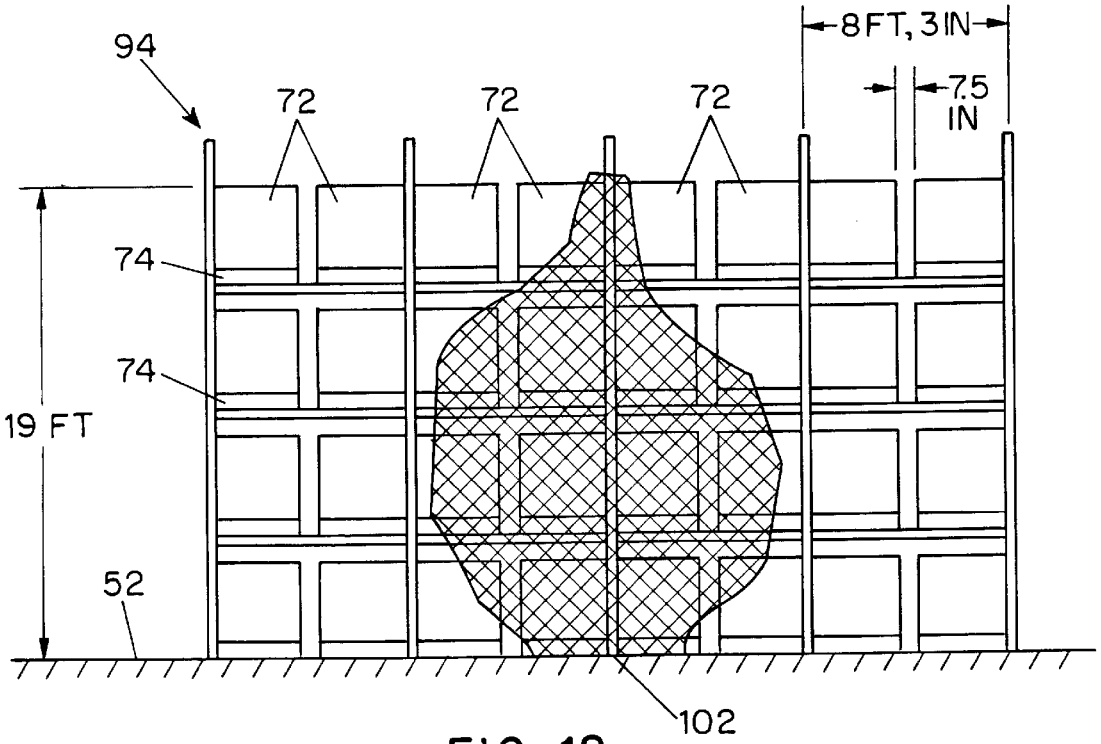
FIG. 12 is a side view of the center portion of the arrangement shown in FIG. 10 indicating the extent of fire damage during the test.
Figure 13:
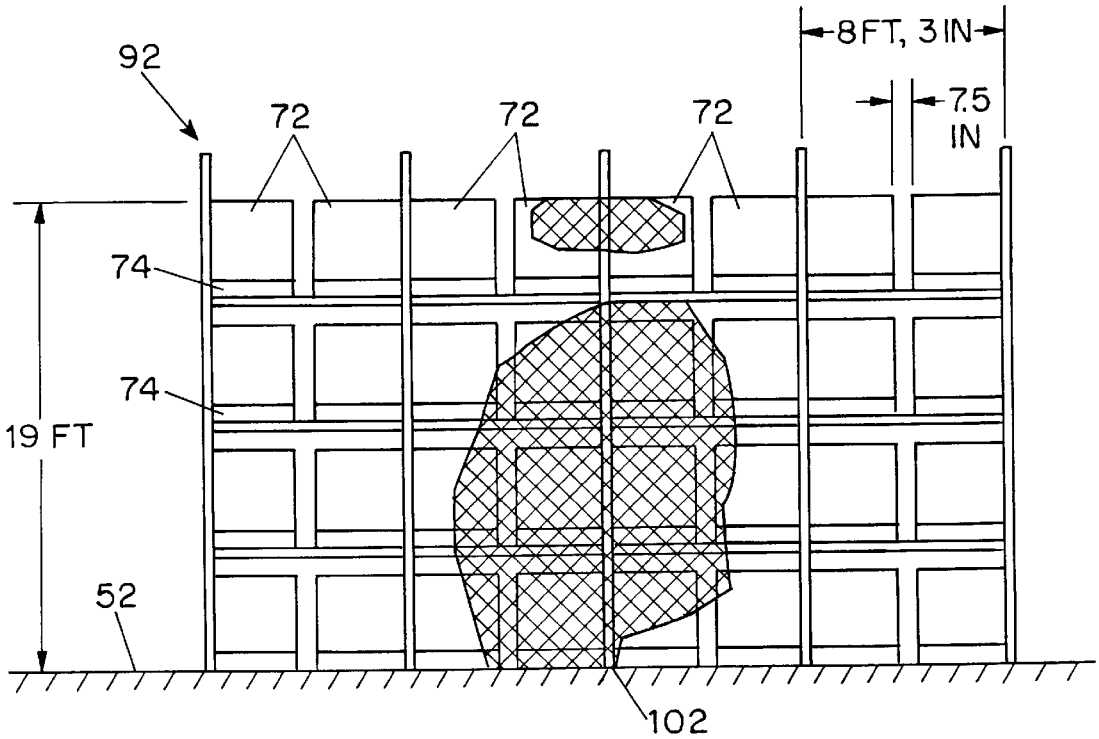
FIG. 13 is a side view of the opposite side of the center portion of the arrangement shown in FIG. 10 indicating the fire damage during the test.

FIG. 11 illustrates the change in temperature with time at a location adjacent to the ceiling directly above the ignition point 102. With one exception, all of the sprinklers over the racks in the rows 76, 78 and 80, as well as the sprinklers in those rows adjacent to the ends of the racks were activated in no more than about 3½ minutes, with the first sprinkler being activated in less than 2½ minutes after ignition. As a result, as shown in FIG. 11, the temperature at the location above the point of ignition rose to a peak at approximately 3½ minutes after ignition and immediately dropped back to a level below 100° C. within about 30 seconds and remained below that level for the balance of the test. In this test, as shown in FIG. 12, fourteen of the pallets in the rack 94 and fourteen of the pallets in the rack 92 suffered some fire damage and the total number of pallet loads consumed was fifteen. None of the pallets in either of the racks 90 and 96 was damaged.

EXAMPLE 3

Figure 14:
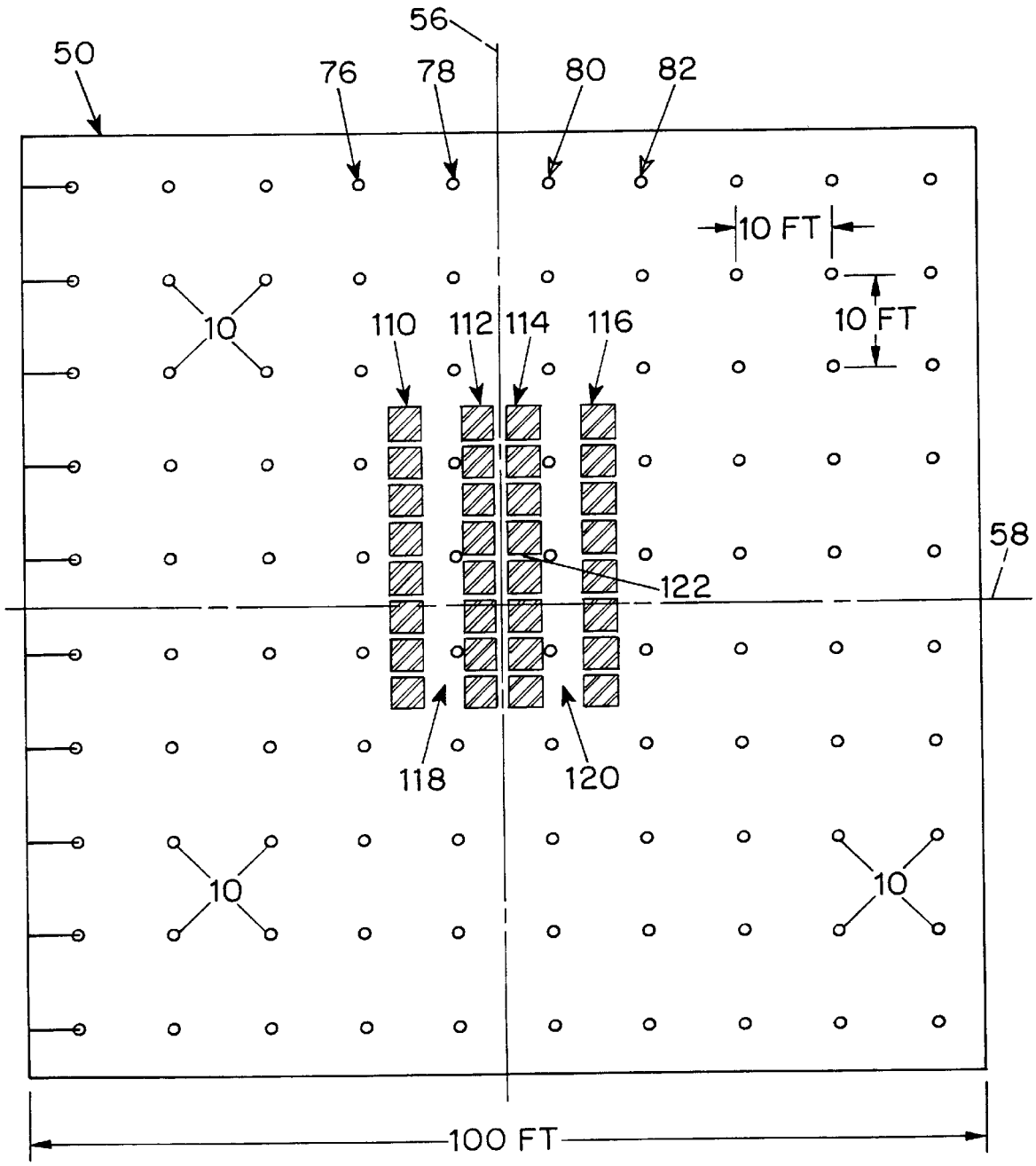
FIG. 14 is a plan view showing the arrangement of sprinklers for representative special occupancy hazards in a third example of the invention.

In this example four racks 110, 112, 114 and 116 arranged as described above with respect to Example 1 were positioned in the manner illustrated in FIG. 14 with eight-foot aisles 118 and 120 between the racks 110 and 112 and 114 and 116, respectively. The racks 112 and 114 were located between the rows of sprinklers 78 and 80 with three sprinklers over each of the aisles 118 and 120 and the ends of the racks approximately half-way between adjacent sprinklers in each of those rows. The pallets contained the same type of Class II test commodities and the sprinklers had the same water pressure as in the first example. In this example the ceiling 54 was about 21 feet above the floor 52 and the sprinklers 10 were about 20 inches above the top of the stacked pallets. As in the first example, an ignition point 122 was located adjacent to the floor 52 and between the fourth and fifth columns of pallets in the rack 114.

Figure 15:
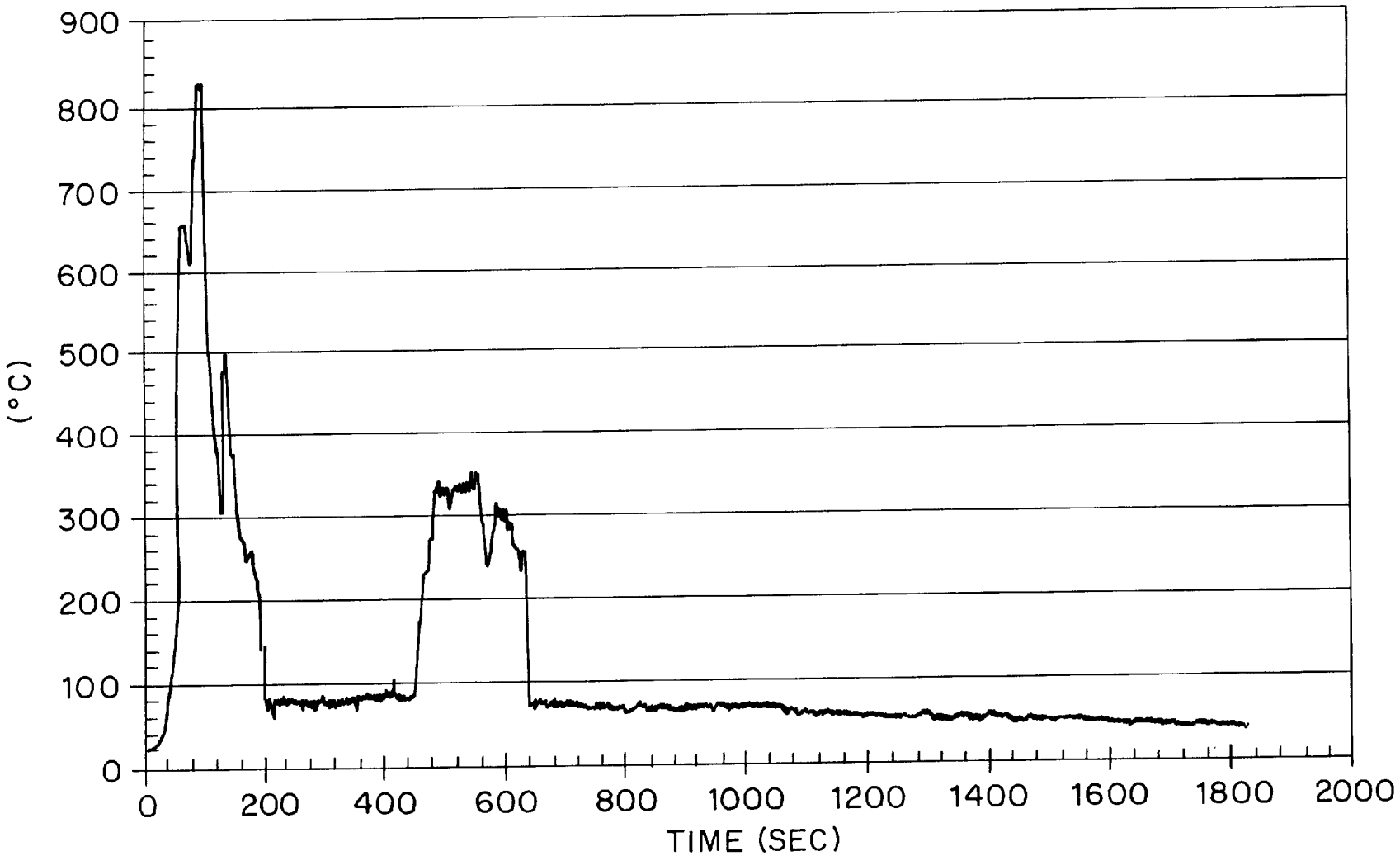
FIG. 15 is a graphical illustration showing the change in temperature with time above the point of ignition during a test of the third example.
Figure 16:
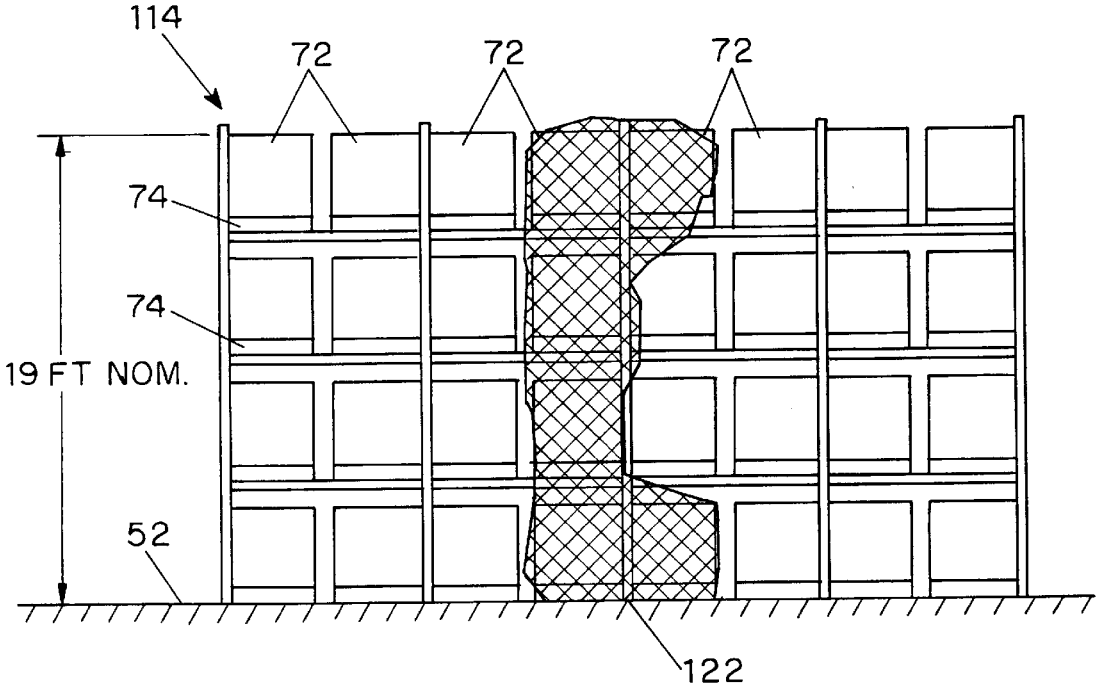
FIG. 16 is a side view of the center portion of the arrangement shown in FIG. 14 indicating the extent of damage during the test of the third example.
Figure 17:
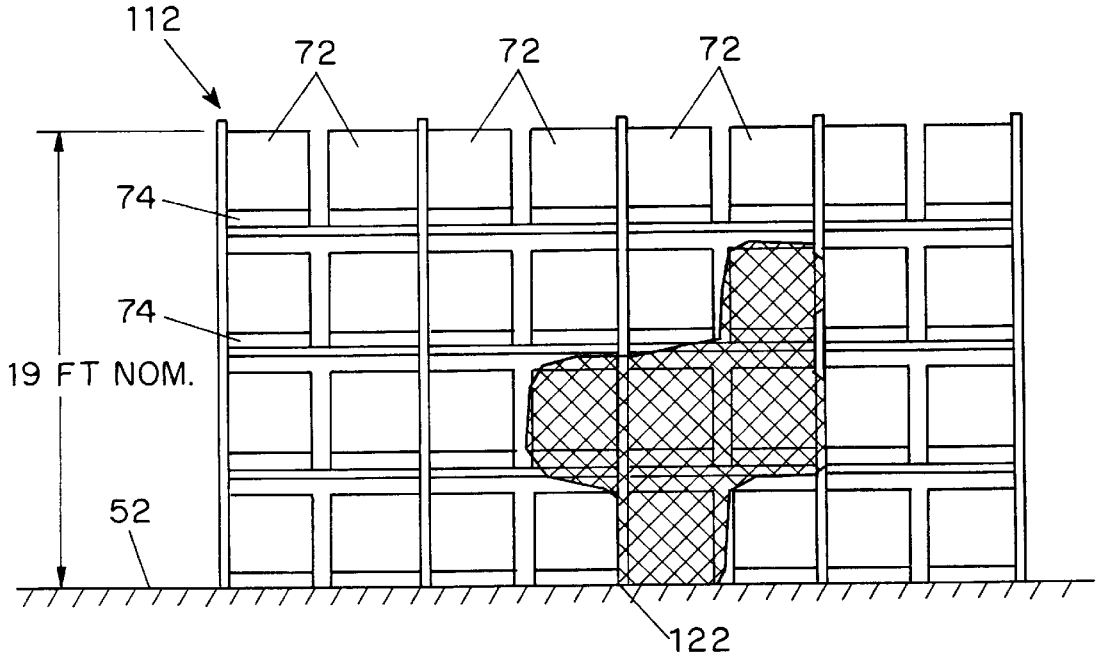
FIG. 17 is a view of the opposite side of the center portion of the arrangement shown in FIG. 14 indicating the extent of damage during the test.

FIG. 15 shows the variation of temperature with time at a location near the ceiling 54 directly above the ignition point. In this case, each of the three sprinklers in the rows 78 and 80 over each of the aisles 118 and 120 was actuated within two minutes after ignition and the two sprinklers in the row 78 adjacent to the ends of the rack 112 were actuated within 1½ minutes. As indicated in FIG. 15, the temperature of the air above the ignition point, after reaching a peak at about two minutes, decreased rapidly to fall below 100° C. at about 3½ minutes, and following a further increase in temperature for about 3½ minutes, fell again below 100° C. FIG. 16 indicates the extent of fire damage to the pallets in the rack 114 and FIG. 17 indicates the extent of damage to the pallets in the rack 112. There was no damage to the pallets in the racks 110 and 116. In this case, thirteen pallets sustained some damage and the total number of pallet loads consumed was nine.

EXAMPLE 4

In a further test to establish the effectiveness of the present invention for special occupancy hazards including plastic materials, as well as Group II materials, the room 50 was provided with an array of pendent sprinklers 10 of the type described above spaced by ten feet in one direction and by eight feet in the orthogonal direction. In this case the water pressure applied to the sprinklers was 12 psi (0.8 bar), providing a density of 0.6 gallons per minute per square foot at the location of the commodities. Essentially, the same water density would be provided at 7 psi (0.5 bar) if sprinklers having a nominal K factor of 17 were substituted. Moreover, if the sprinklers were spaced ten feet by ten feet the same water density would be obtained if sprinklers having a nominal K factor of 22 were used. If sprinklers having a K factor of 25 were substituted, using a pressure of 7 psi (0.5 bar), the water density could be increased to 0.66 gallons per minute per square foot, i.e., about ten percent above that produced by K 14 sprinklers at 12 psi (0.8 bar).

Figure 18:
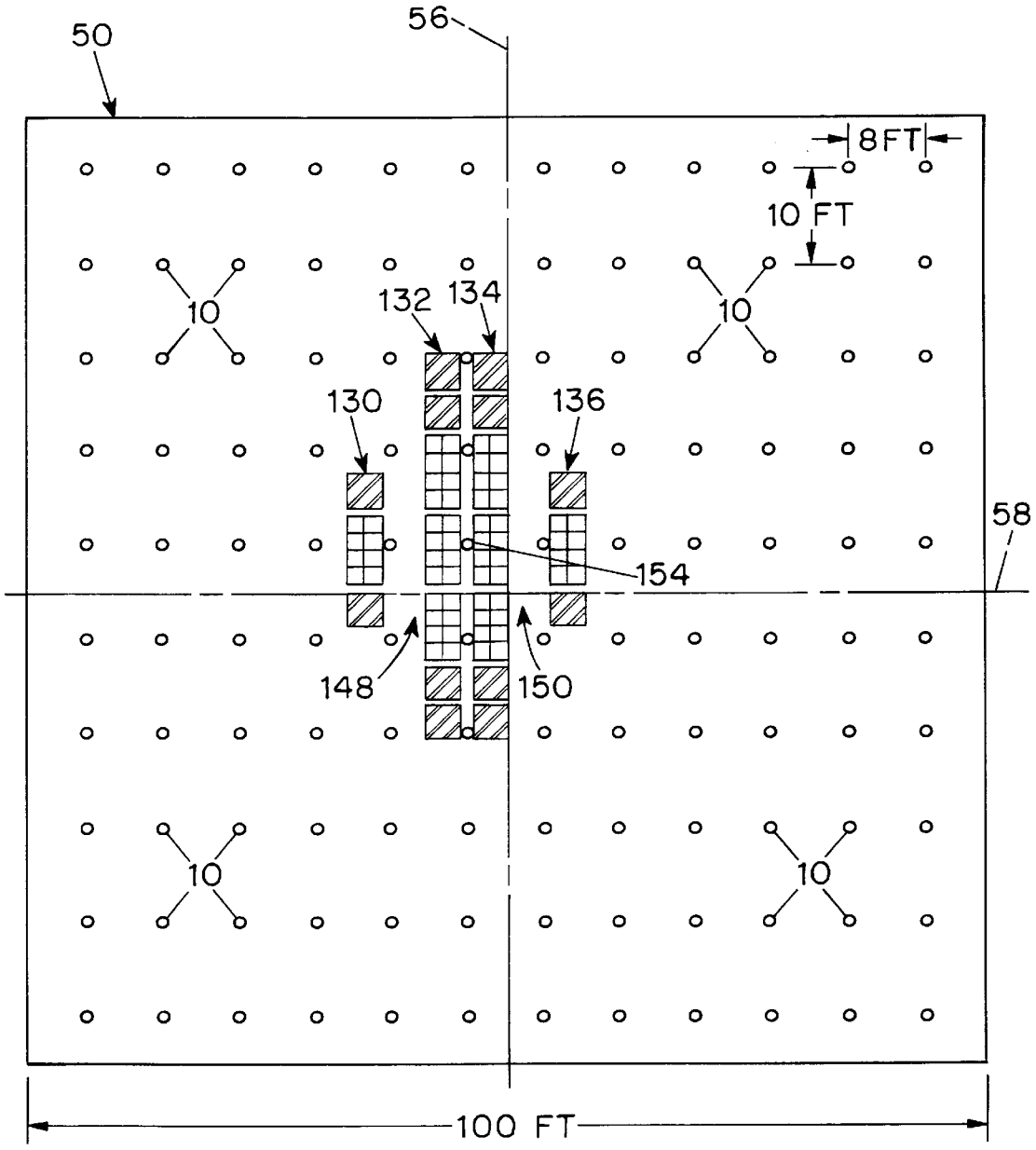
FIG. 18 is a plan view showing the arrangement of sprinklers for representative special occupancy hazards in a fourth example of the invention.

As shown in FIG. 18, four racks 130, 132, 134 and 136 were positioned under five adjacent rows of sprinklers 138, 140, 142, 144 and 146 spaced eight feet apart. The racks 132 and 134 were spaced by six inches and were placed so that the space between those racks was directly below the row of sprinklers 142. Two aisles 148 and 150, each eight feet wide, were provided between the racks 130 and 132 and 134 and 136, respectively, with the aisle 148 located beneath five sprinklers in the row 140 and the aisle 150 located beneath five sprinklers in the row 144.

Figure 19:
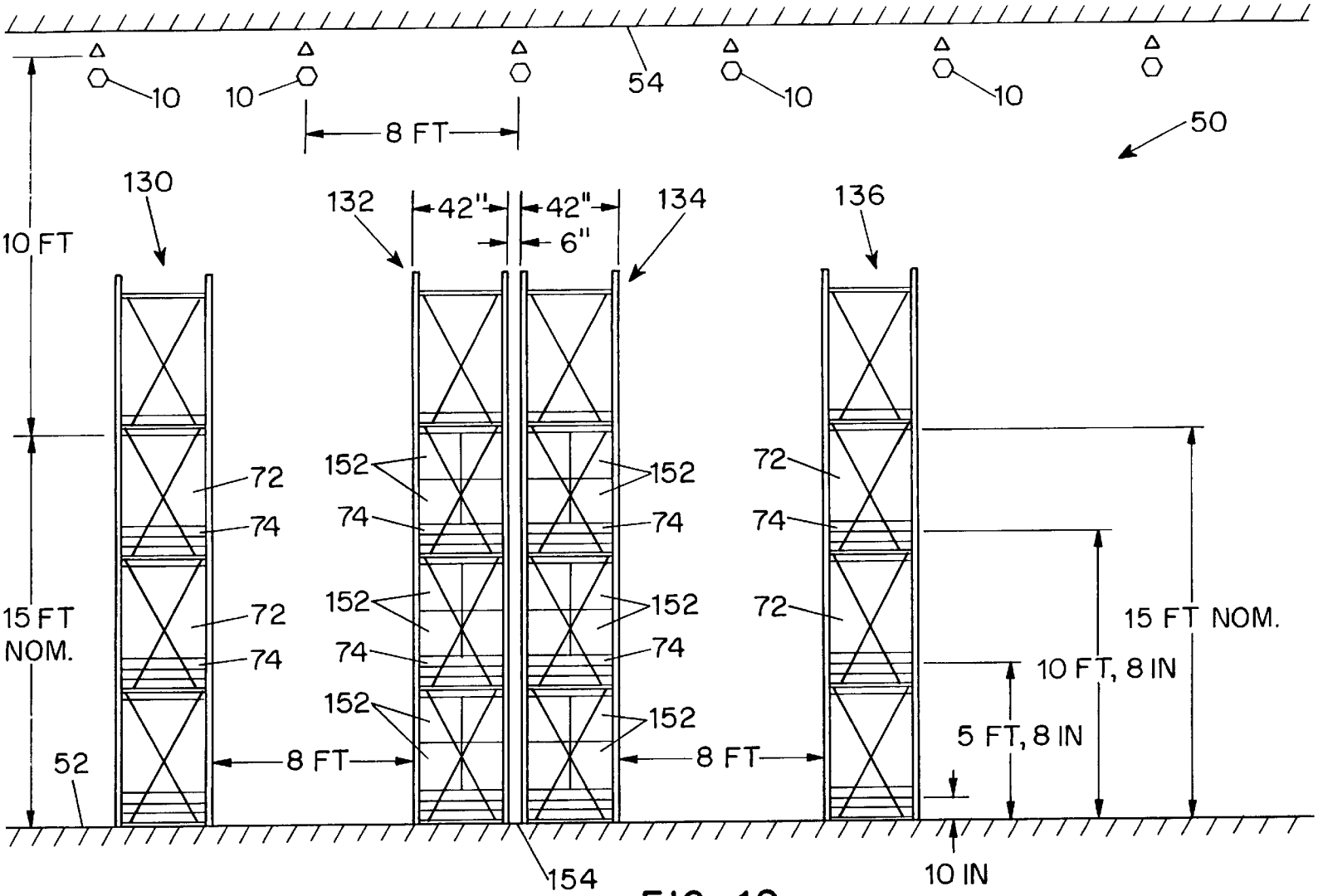
FIG. 19 is an end view of the arrangement of stored commodities in the fourth example.
Figure 20:
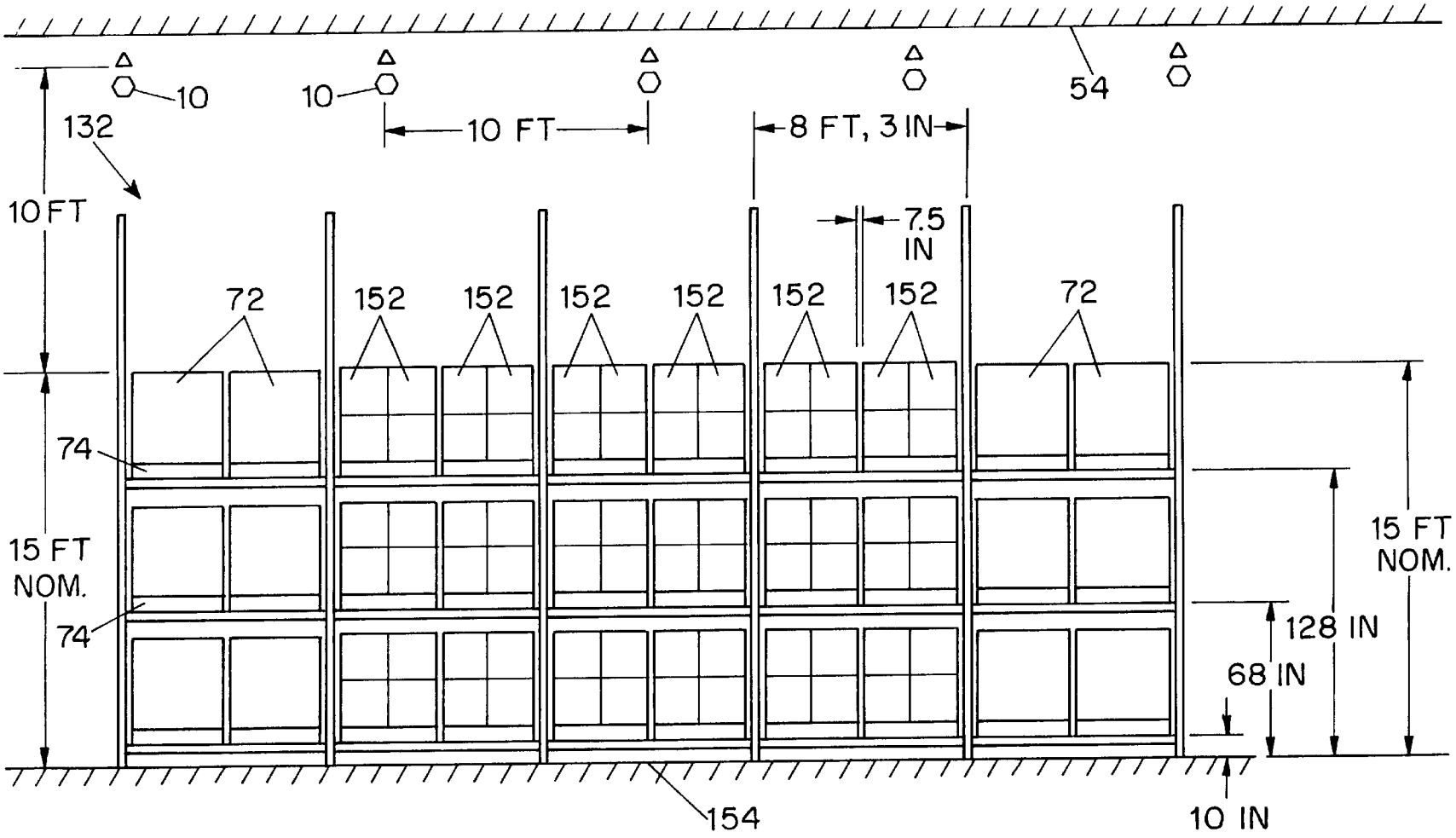
FIG. 20 is a side view of the central portion of the storage arrangement in the fourth example.

As best seen in FIGS. 19 and 20, the six central columns of pallets in the racks 132 and 134 and the two central columns of pallets in the racks 130 and 136 were provided with three pallets in each column, each pallet holding eight cartons 152 containing a Group A plastic commodity. These cartons, labeled "Group A", were single wall corrugated cardboard cartons measuring 20 inches by 20 inches by 20 inches, each containing 125 crystalline polystyrene cups in separate compartments within the carton. The compartmentation consisted of single wall corrugated cardboard sheets to separate five layers of cups and interlocking single-wall corrugated cardboard vertical dividers to separate five rows and five columns comprising each layer. Eight of the cartons were arranged in a 2 by 2 by 2 array, with the open ends of the cups facings down, and placed on a 42 inch by 42 inch by 5 inch high hardware pallet. The other pallets in the racks contained the same Group II commodity as in the previous examples.

In this example, the sprinklers 10 were located approximately ten feet above the top of the cartons and the ignition location 154 was adjacent to the floor 52 and centrally located in the space between the two racks 132 and 134 as shown in FIGS. 18–20. During the test the sprinkler directly over the ignition point was activated within one minute and three sprinklers over the aisle 148, three other sprinklers above the racks 132 and 134 and two sprinklers over the aisle 150 were activated within approximately two minutes of ignition.

Figure 21:
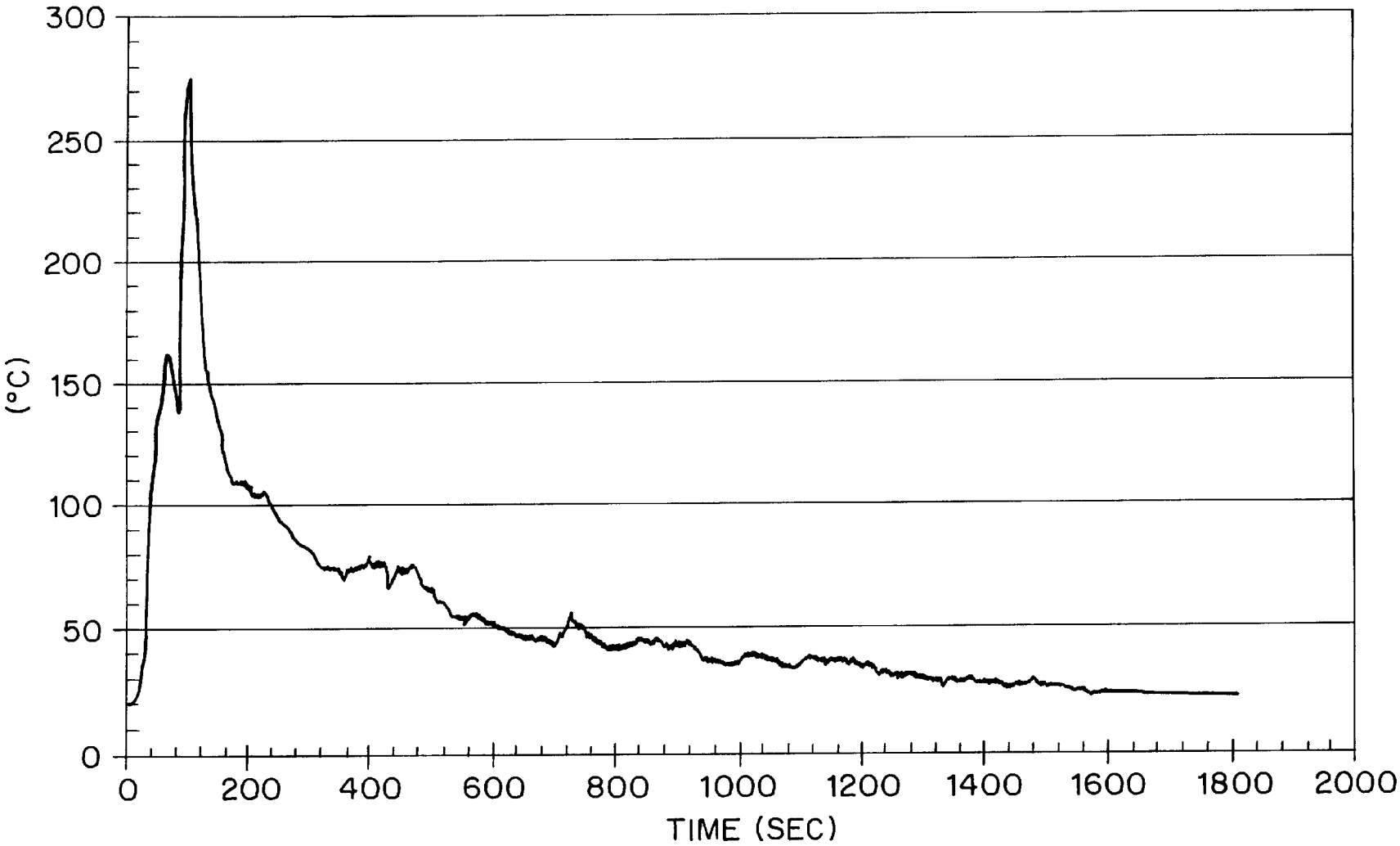
FIG. 21 is a graphical illustration showing the change in temperature with time above the ignition point during a test of the fourth example.
Figure 22:
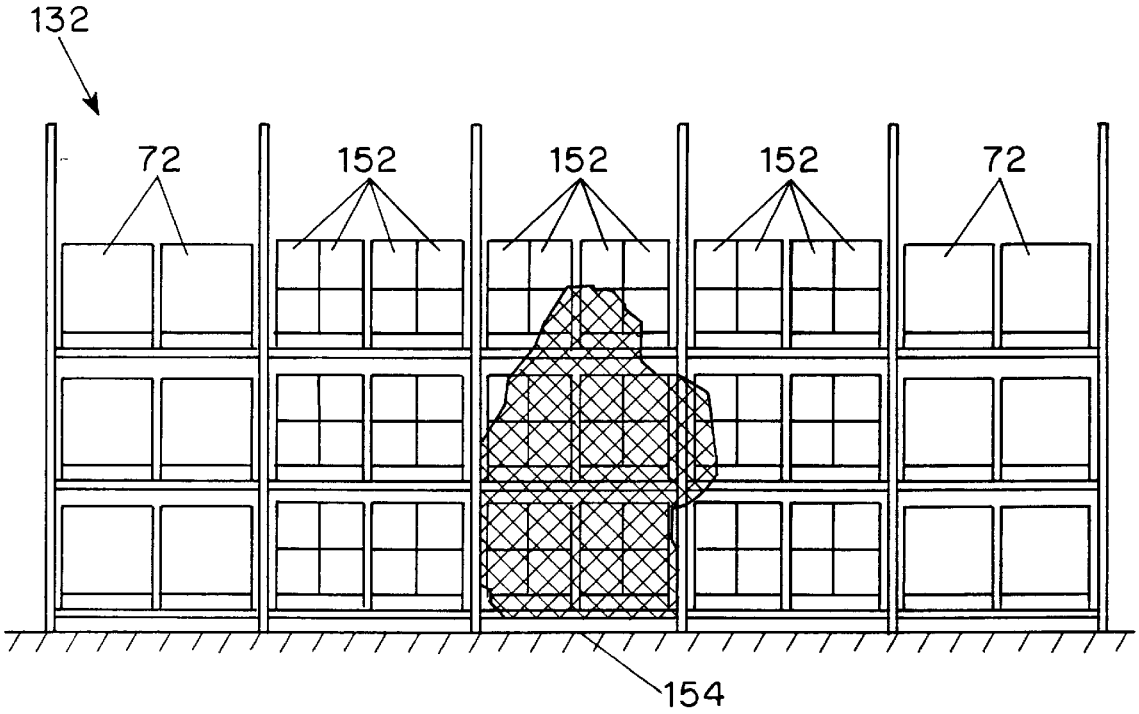
FIG. 22 is a side view of the center portion of the arrangement indicating the extent of damage during the test.
Figure 23:
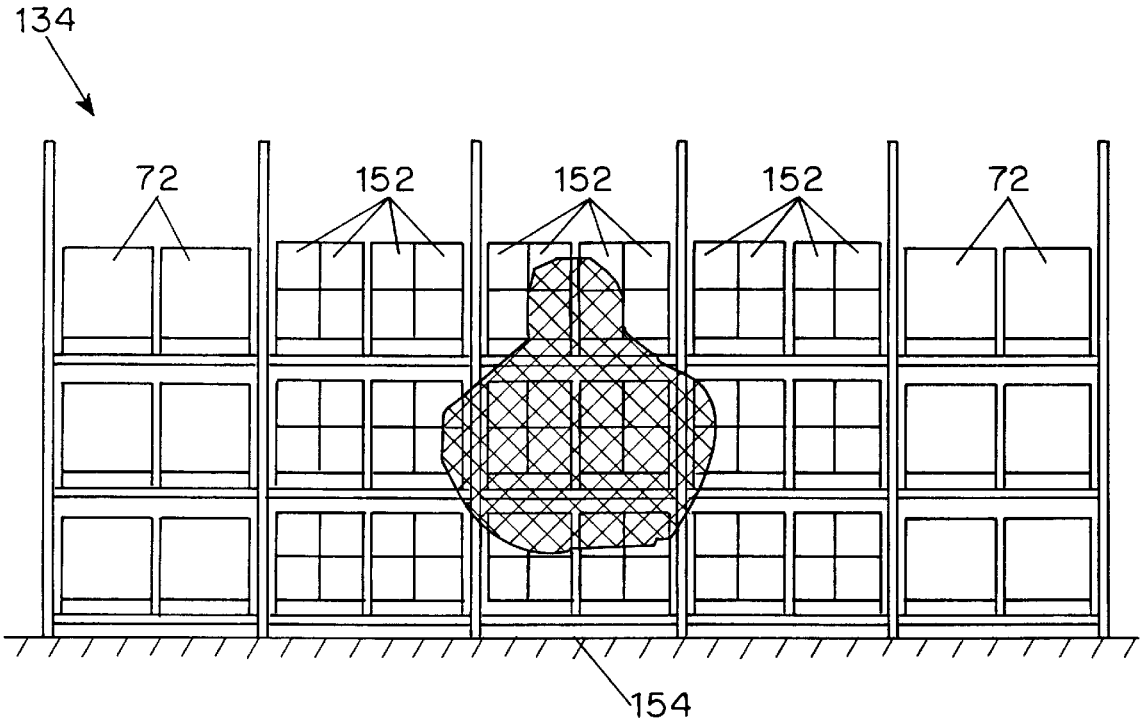
FIG. 23 is a view of the opposite side of the center portion indicating the extent of damage during the test.
Figure 24:
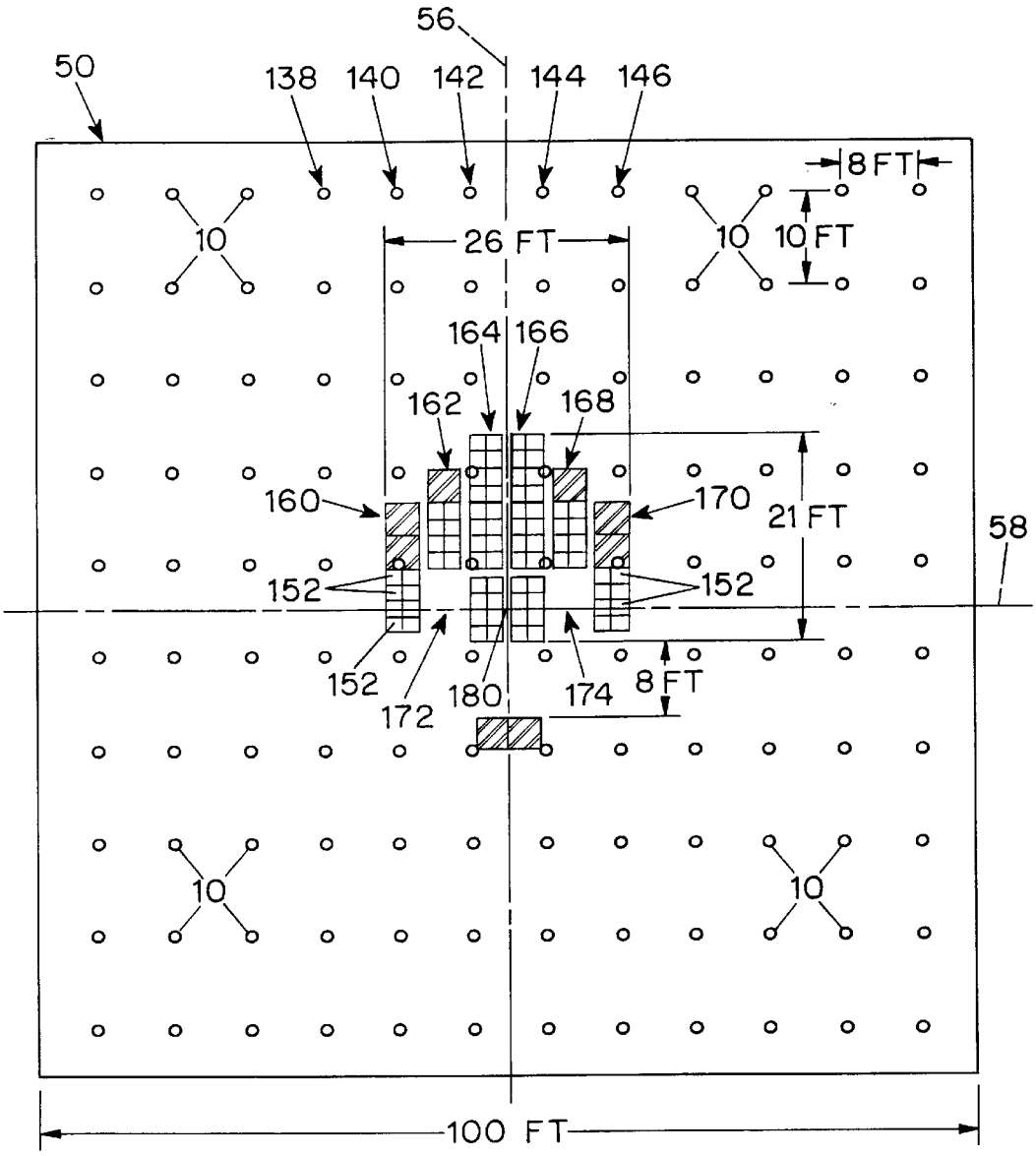
FIG. 24 is a plan view showing the arrangement of sprinklers for representative special occupancy hazards in a fifth example in accordance with the invention.

FIG. 21 illustrates the change in temperature with time at the location adjacent to the ceiling directly above the ignition point 154. As shown by that graph, the temperature dropped rapidly from a maximum of about 275° C. to about 100° C. in less than three minutes and continued to decrease thereafter, indicating rapid extinction of the fire. FIG. 22 indicates the damage to the commodities in the rack 132 and FIG. 23 indicates the damage to the commodities in the rack 134, showing that only the commodities in the generally central portion of those racks suffered damage. There was no damage to any of the commodities in the racks 130 and 136. In this example, a total of five pallet loads of commodities was consumed.

EXAMPLE 5

In this example, Class II commodities in cartons 72 and Group A plastic commodities in cartons 152 of the type described above with respect to Example 4 were stored in six adjacent racks 160, 162, 164, 166, 168 and 170 beneath the rows of sprinklers 138, 140, 142, 144 and 146 supplied with water at a pressure of 12 psi (0.8 bar). The sprinklers had an activation temperature of 286° F. (141° C.). In this case, partial aisles 172 and 174 were provided at the ends of the stacks 162 and 168, respectively and the last two columns of pallets in the racks 164 and 166 were spaced from the remainder of pallets in those racks. Type A commodities comprising plastic cups of the type described above were stored in all of the pallets except for the two spaced columns of pallets in the racks 164 and 166, the two columns of pallets in the racks 160 and 170 which were not adjacent to the aisles 172 and 174, and the columns of pallets at the ends of the racks 162 and 168 opposite from the aisles 172 and 174. In this case, the ignition point 180 was adjacent to the floor 52 and located in the space between the racks 164 and 166 and between the two pallets in those racks which are adjacent to the aisles 172 and 174.

Following ignition, three sprinklers in the row 142 and three sprinklers in the row 144 over the central area of the racks were actuated within about three minutes and the sprinkler in the row 144 over the pallets in the rack 166 spaced from the other pallets was actuated after about 3½ minutes. In addition, the three sprinklers in the row 146 over the rack 160 were actuated in less than three minutes. Two sprinklers over the rack 160 adjacent to the aisle 172 were actuated within three minutes and one sprinkler in the row 138 adjacent to the end of the rack 160 was actuated after 3¼ minutes.

Figure 25:
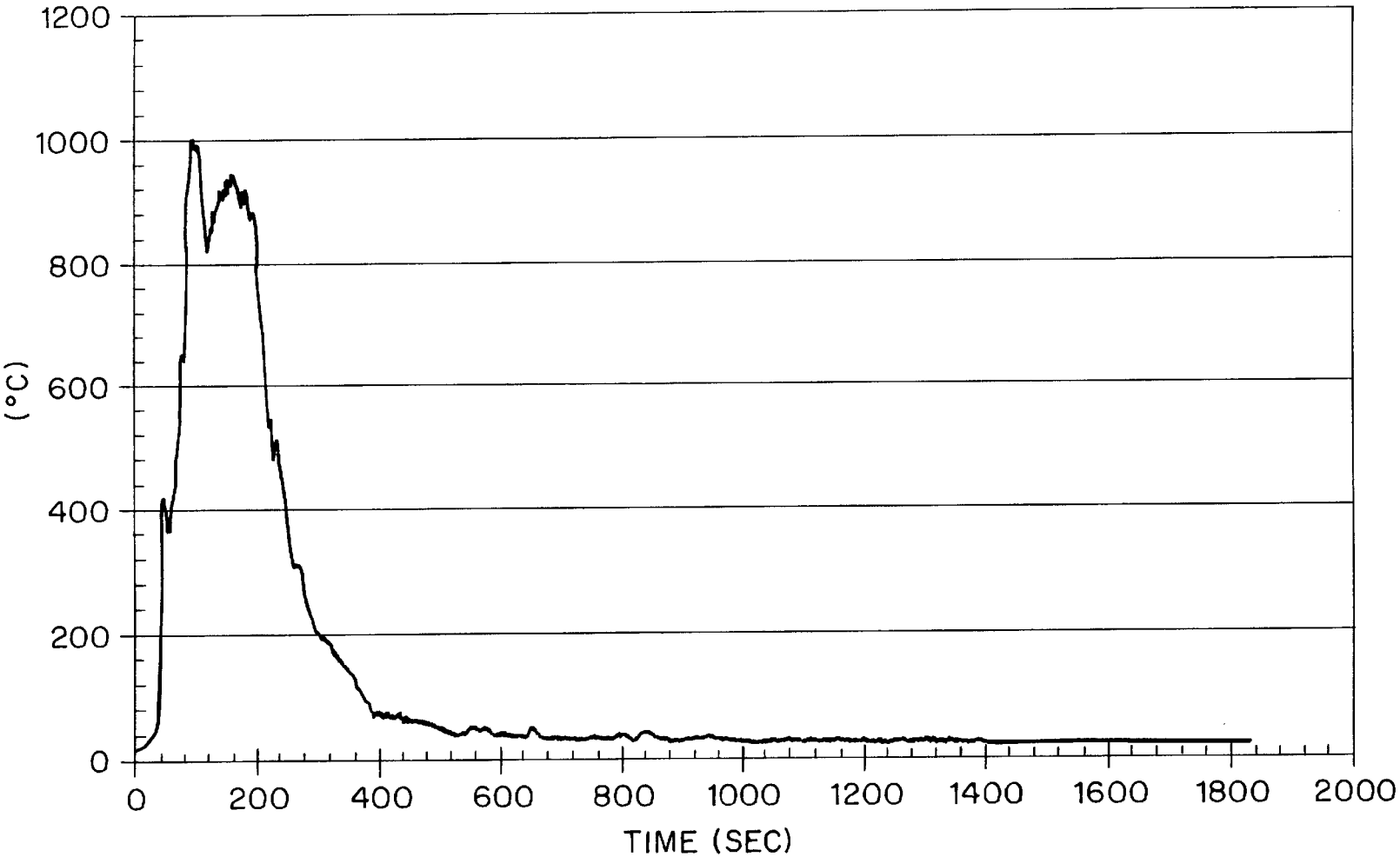
FIG. 25 is a graphical illustration showing the change in temperature with time above the ignition point during a test of the fifth example.
Figure 26:
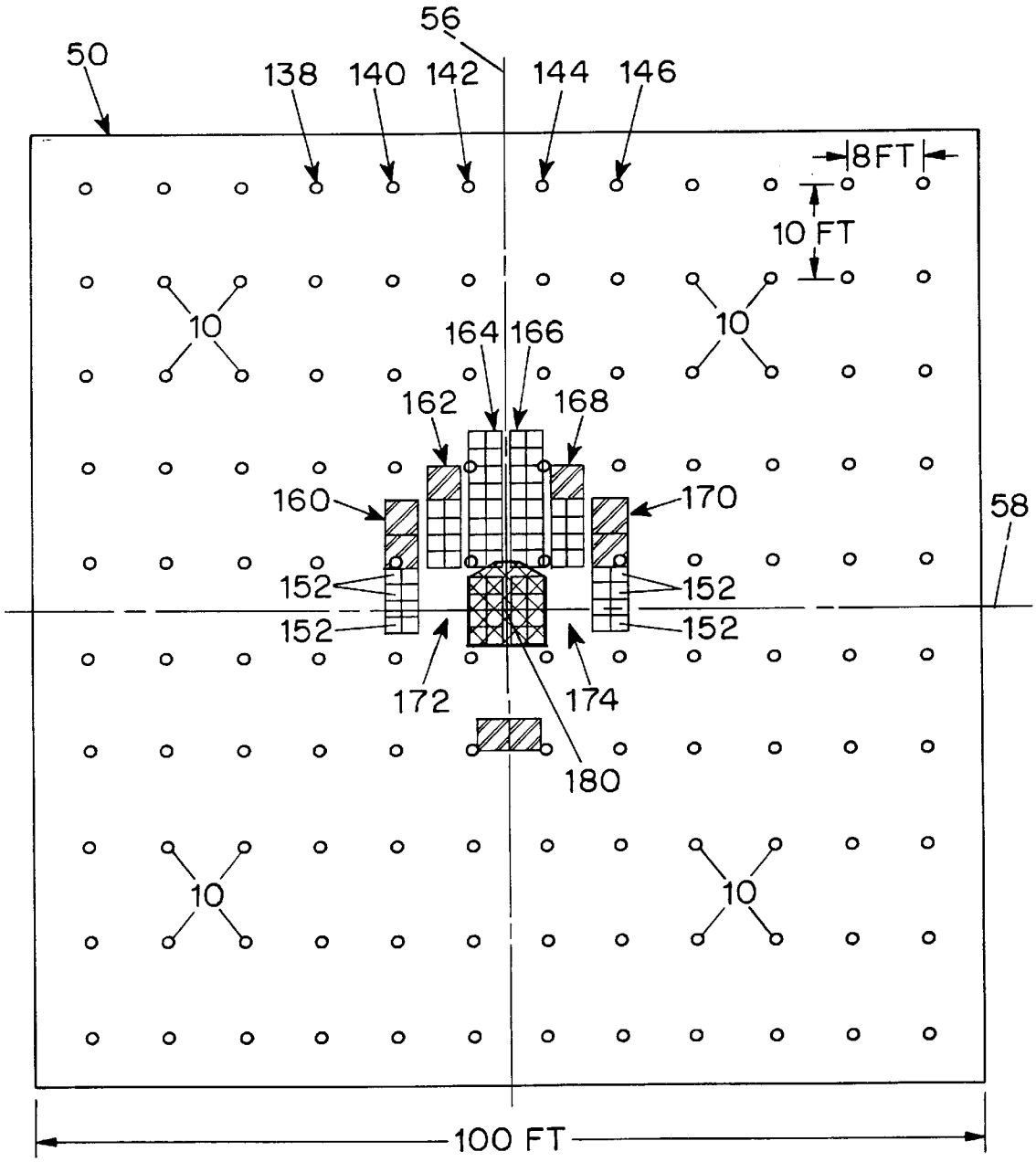
FIG. 26 is a plan view indicating the extent of damage during a test of the fifth example.
Figure 27:
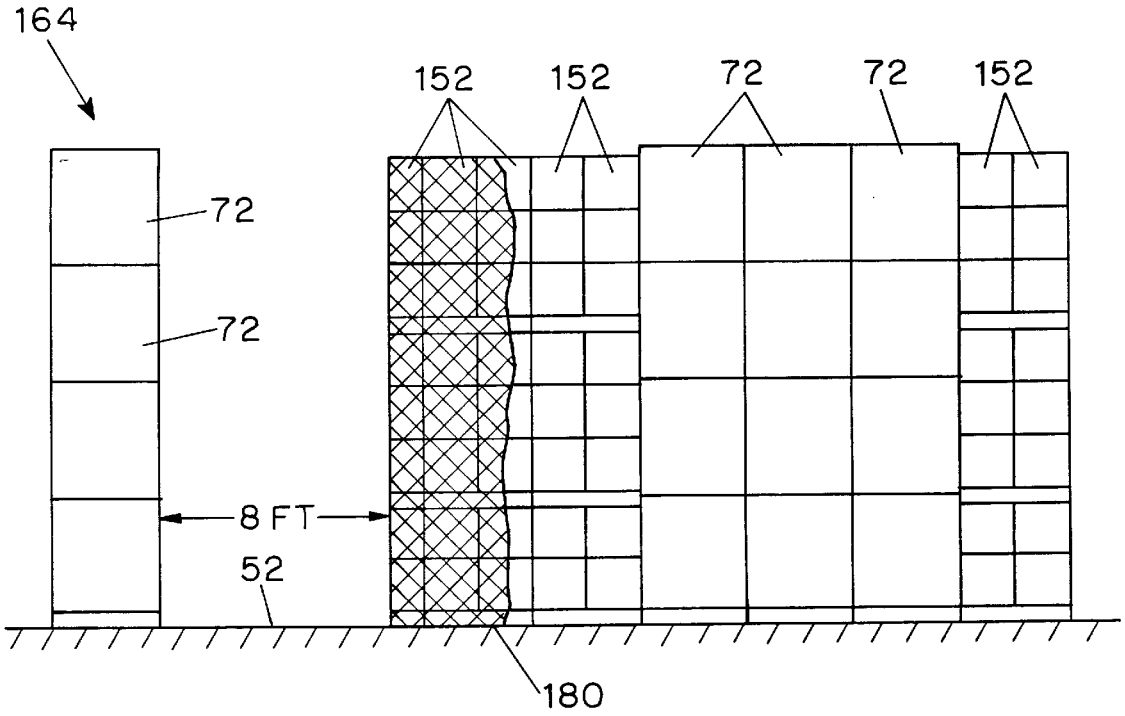
FIG. 27 is a side view of the center portion indicating the extent of damage during the test.
Figure 28:
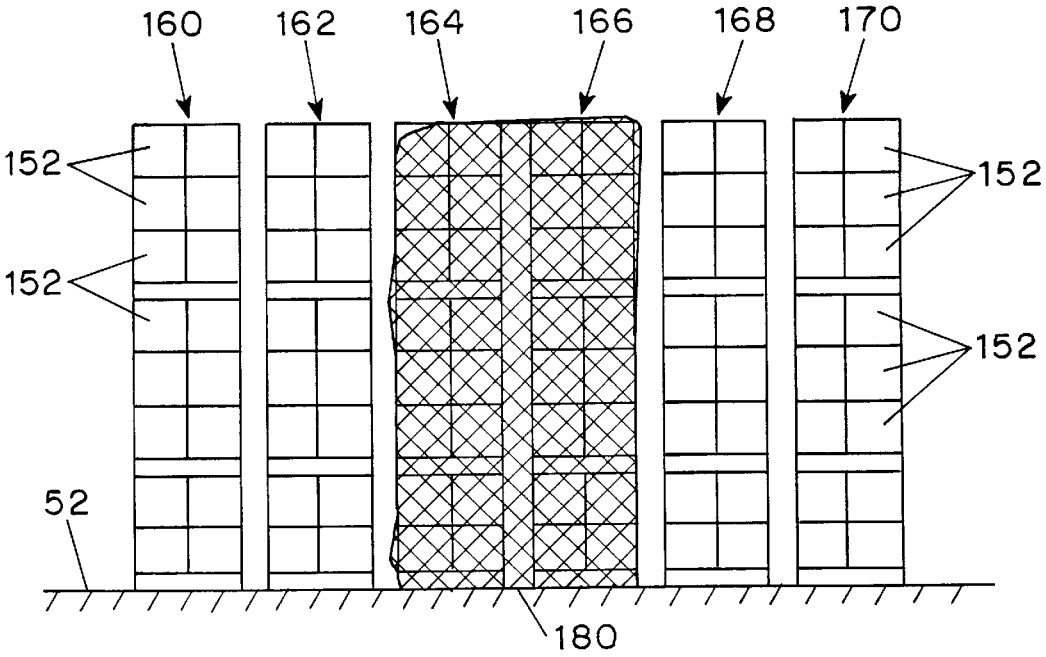
FIG. 28 is an end view showing the extent of damage during the test.

FIG. 25 illustrates the change of temperature with time at a location adjacent to the ceiling above the ignition point and shows that, after five minutes, the temperature had dropped from a peak of nearly 1000° C. at one and one-half minutes to about 200° C. and during the next minute was reduced below 100° C. FIGS. 26, 27 and 28 show the extent of fire damage in this test, indicating that only the materials stored on the last two columns of pallets adjacent to the aisles 172 and 174 in the racks 164 and 166 were damaged. The total amount of commodity consumed in this test was about five pallet loads.

From the foregoing examples, which are representative of all special occupancy hazards as defined herein, it is apparent that special occupancy hazards can be protected effectively using sprinklers having a ¾ inch (19 mm.) orifice size (K14) or larger orifice sprinklers such as K17, K22 and K25 with water pressures as low as 7 psi (0.5 bar) despite the belief of those generally knowledgeable in the industry that such protection would not be possible.

Although the invention has been described herein with specific embodiments, many modifications and variations therein will readily occur to those skilled in the art. Accordingly, all such variations and modifications are included within the intended scope of the invention.

I claim:

1. A fire protection sprinkler arrangement for protecting special occupancy hazards comprising:

a storage space for commodities; and an array of sprinklers disposed above the storage space with each sprinkler arranged to supply water to a protected area of no more than about one hundred square feet;

wherein each sprinkler comprises:

a sprinkler body connected to a water supply line and having a K factor of at least 14; and a deflector supported from the sprinkler body and spaced from an orifice in the sprinkler body to deflect water passing through the orifice at a minimum pressure of less than about 12 psi (0.8 bar) over the area to be protected at a density of at least 0.37 gallons per minute per square foot;

the storage space beneath the array of sprinkler being occupied, at least in part, by a special occupancy hazard commodity.

2. A sprinkler arrangement according to claim 1 wherein the special occupancy hazard commodity is a NFPA Class I commodity.

3. A sprinkler arrangement according to claim 1 wherein the special occupancy hazard commodity is a NFPA Class II commodity.

4. A sprinkler arrangement according to claim 1 wherein the special occupancy hazard commodity is a NFPA Class III commodity.

5. A sprinkler arrangement according to claim 1 wherein the special occupancy hazard commodity is a NFPA Class IV commodity.

6. A sprinkler arrangement in accordance with claim 1 wherein each sprinkler is spaced no more than ten feet from an adjacent sprinkler.

7. A sprinkler arrangement according to claim 1 wherein the sprinklers are spaced by no more than about ten feet in one direction and by no more than about eight feet in a direction orthogonal thereto.

8. A sprinkler arrangement according to claim 7 wherein the commodities are stored on pallets in a plurality of racks in which a plurality of pallets are stacked at least three high on the racks and wherein the racks extend in a direction parallel to the direction in which the sprinklers are spaced by no more than about ten feet.

9. A sprinkler arrangement in accordance with claim 1 wherein the commodities are stored on pallets in a plurality of racks in which a plurality of pallets are stacked at least three high on the racks.

10. A sprinkler arrangement according to claim 9 wherein the plurality of racks is arranged with aisles extending between pairs of adjacent racks.

11. A sprinkler arrangement according to claim 9 wherein the sprinkler arrangement according to claim 10 wherein the sprinklers are located at least eighteen inches above the commodities.

12. A sprinkler arrangement according to claim 1 wherein the orifice in each sprinkler is normally closed with a thermally responsive release element arranged to be activated at a temperature of at least 155° F. (68° C.).

13. A sprinkler arrangement according to claim 1 wherein each sprinkler is positioned in the pendent orientation.

14. A sprinkler arrangement according to claim 1 wherein each sprinkler includes a deflector having slots extending at an angle to a radius from the center of the deflector.

15. A sprinkler arrangement according to claim 1 wherein the commodities are stored in racks spaced by aisles.

16. A sprinkler arrangement according to claim 15 including at least one row of sprinklers over each of the aisles.

17. A sprinkler arrangement according to claim 15 wherein at least one row of sprinklers extends over at least one of the racks.

18. A sprinkler arrangement according to claim 1 wherein the water distribution density provided by the sprinkler is at least 0.6 gallons per minute per square foot.

19. A fire protection sprinkler arrangement for protecting special occupancy hazards comprising:

a storage space for special occupancy hazard plastic commodities; and an array of sprinklers disposed above the storage space with each sprinkler arranged to supply water to a protected area of no more than about one hundred square feet;

wherein each sprinkler comprises;

a sprinkler body connected to a water supply line and having a K factor of at least 14; and a deflector supported from the sprinkler body and spaced from an orifice in the sprinkler body to deflect water passing through the orifice at a minimum pressure of less than about 12 psi (0.8 bar) over the area to be protected at a rate of at least 0.37 gallons per minute per square foot.

20. A sprinkler arrangement according to claim 19 wherein the orifice in each sprinkler is normally closed with a thermally responsive release element arranged to release the sprinkler at a temperature of at least 155° F. (68°).

21. A sprinkler arrangement according to claim 19 wherein each sprinkler is positioned in the pendent orientation.

22. A sprinkler arrangement according to claim 19 wherein each sprinkler includes a deflector having slots extending at an angle to a radius from the center of the deflector.

23. A sprinkler arrangement in accordance with claim 19 wherein the commodities are stored on pallets in a plurality of racks in which a plurality of pallets are stacked at least three high on the racks.

24. A sprinkler arrangement according to claim 19 wherein the plurality of racks is arranged with aisles extending between pairs of adjacent racks.

25. A sprinkler arrangement according to claim 24 wherein each sprinkler is spaced from an adjacent sprinkler by no more than ten feet in one direction and no more than eight feet in a direction orthogonal thereto.

26. A sprinkler arrangement according to claim 25 wherein the racks extend in a direction parallel to the direction in which the sprinklers are spaced by no more than about ten feet.

27. A sprinkler arrangement according to claim 24 wherein the racks are spaced by aisles and including at least one row of sprinklers over each of the aisles.

28. A sprinkler arrangement according to claim 24 wherein at least one row of sprinklers extends over at least one of the racks.

29. A sprinkler arrangement according to claim 19 wherein the water distribution density provided by the sprinklers is at least 0.6 gallons per minute per square foot.

30. A fire protection sprinkler arrangement for protecting special occupancy hazards comprising:

a storage space for commodities; and an array of sprinklers disposed above the storage space with each sprinkler arranged to supply water to a protected area of no more than about one hundred square feet;

wherein each sprinkler comprises:

a sprinkler body connected to a water supply line and having a K factor of at least 14; and a deflector supported from the sprinkler body and spaced from an orifice in the sprinkler body to deflect water passing through the orifice at a minimum pressure of less than about 10 psi (0.7 bar) over the area to be protected at a rate of at least 0.37 gallons per minute per square foot;

the storage space beneath the array of sprinklers being occupied, at least in part, by a special occupancy hazard commodity.

31. A sprinkler arrangement according to claim 30 wherein the special occupancy hazard commodity is a NFPA Class I commodity.

32. A sprinkler arrangement according to claim 30 wherein the special occupancy hazard commodity is a NFPA Class II commodity.

33. A sprinkler arrangement according to claim 30 wherein the special occupancy hazard commodity is a NFPA Class III commodity.

34. A sprinkler arrangement according to claim 30 wherein the special occupancy hazard commodity is a NFPA Class IV commodity.

35. A sprinkler arrangement in accordance with claim 30 wherein each sprinkler is spaced no more than ten feet from an adjacent sprinkler.

36. A sprinkler arrangement according to claim 30 wherein the sprinklers are spaced by no more than about ten feet in one direction and by no more than about eight feet in a direction orthogonal thereto.

37. A sprinkler arrangement according to claim 36 wherein the commodities are stored on pallets in a plurality of racks in which a plurality of pallets are stacked at least three high on the racks and wherein the racks extend in a direction parallel to the direction in which the sprinklers are spaced by no more than about ten feet.

38. A sprinkler arrangement in accordance with claim 30 wherein the commodities are stored on pallets in a plurality of racks in which a plurality of pallets are stacked at least three high on the racks.

39. A sprinkler arrangement according to claim 38 wherein the plurality of racks is arranged with aisles extending between pairs of adjacent racks.

40. A sprinkler arrangement according to claim 38 wherein the sprinklers are located at least eighteen inches above the commodities.

41. A sprinkler arrangement according to claim 30 wherein the orifice in each sprinkler is normally closed with a thermally responsive release element arranged to be activated at a temperature of at least 155° F. (68° C.).

42. A sprinkler arrangement according to claim 30 wherein each sprinkler is positioned in the pendent orientation.

43. A sprinkler arrangement according to claim 30 wherein each sprinkler includes a deflector having slots extending at an angle to a radius from the center of the deflector.

44. A sprinkler arrangement according to claim 30 wherein the commodities are stored in racks spaced by aisles.

45. A sprinkler arrangement according to claim 44 including at least one row of sprinklers over each of the aisles.

46. A sprinkler arrangement according to claim 44 wherein at least one row of sprinklers extends over at least one of the racks.

47. A sprinkler arrangement according to claim 30 wherein the water distribution density provided by the sprinkler is at least 0.6 gallons per minute per square foot.

48. A sprinkler arrangement in accordance with claim 38 wherein the deflector deflects water passing through the orifice at a pressure in the range from about 7 psi (0.5 bar) to less than about 10 psi (0.7 bar) over the area to be protected.

49. A fire protection method for protecting special occupancy hazards comprising:

providing a storage place for commodities and an array of sprinklers disposed above the storage space with each sprinkler arranged to supply water to a protected area of no more than about 100 square feet;

wherein each sprinkler comprises a sprinkler body having a K factor of at least 14 connected to a water supply line and a deflector supported from the sprinkler body and spaced from an orifice in the sprinkler body to deflect water passing through the orifice at a rate of at least 0.37 gallons per minute per square foot; and supplying water to each sprinkler from the water supply line at a pressure of less than about 12 psi (0.8 bar).

50. A method according to claim 49 wherein the water is supplied to each sprinkler at a pressure in the range from about 7 psi (0.5 bar) to about 10 psi (0.7 bar).

51. A fire protection sprinkler arrangement comprising a sprinkler body having an axial passage for delivery of water with an orifice having a K factor of at least 14, a water supply line for supplying water to the axial passage at a minimum pressure of less than about 12 psi (0.8 bar), a deflector supported from the sprinkler body and spaced from the axial passage and positioned in a plane generally perpendicular to the axis of the sprinkler body, the deflector having a circumferential array of slots each extending inwardly from the periphery of the deflector and oriented at an angle of at least 20° to a radial line extending through the inner end of the slot so as to supply water to an area of up to one hundred square feet at a density of at least 0.37 gallons per minute per square foot.

52. A sprinkler according to claim 51 wherein each slot is at an angle to the radial line in the range from about 20° to about 50°.

53. A sprinkler according to claim 51 wherein each slot is oriented at an angle to the radial line in the range from 30° to about 40°.

54. A sprinkler according to claim 53 wherein each slot is oriented at an angle to the radial line of approximately 35°.

55. A sprinkler according to claim 51 wherein the deflector has a substantially planar configuration.

56. A sprinkler according to claim 51 wherein the deflector has a diameter in the range from about 1.05 inch to about 1.25 inch.

57. A sprinkler according to claim 56 wherein the deflector has a diameter in the range from about 1.10 inch to about 1.20 inch.

58. A sprinkler according to claim 57 wherein the deflector has a diameter of about 1.15 inch.

59. A sprinkler according to claim 51 wherein each slot has a width in the range from about 0.04 inch to about 0.08 inch.

60. A sprinkler according to claim 59 wherein each slot has a width of about 0.06 inch.

61. A sprinkler according to claim 51 wherein the root diameter of each of the slots is in the range from about 0.6 inch to about 1.0 inch.

62. A sprinkler according to claim 61 wherein the root diameter of each of the slots is in the range from about 0.7 inch to about 0.9 inch.

63. A sprinkler according to claim 62 wherein the root diameter of each of the slots is approximately 0.85 inch.

64. A sprinkler according to claim 51 including a pair of arms extending from the sprinkler body which meet at a boss located on the sprinkler axis spaced from the sprinkler body and the deflector is supported from the boss.

65. A sprinkler according to claim 51 wherein the number of slots in the circumferential array is 15.

66. A sprinkler according to claim 51 wherein the water supply line supplies water to the axial passage at a pressure in the range from about 7 psi (0.5 bar) to about 10 psi (0.7 bar).

* * * * *

UNITED STATES PATENT AND TRADEMARK OFFICE

CERTIFICATE OF CORRECTION

PATENT NO. : 5,915,479
DATED : June 29, 1999
INVENTOR(S) : Gary W. Ponte

It is certified that error appears in the above-identified patent and that said Letters Patent is hereby corrected as shown below:

Column 8,
Line 48: "hardware" should read -- hardwood --.

Column 10,
Line 13: "sprinkler" should read --sprinklers --.
Line 47: delete "the sprinkler arrangement according to claim 10 wherein".

Signed and Sealed this

Thirty-first Day of July, 2001

*Attest:*

Nicholas P. Godici

*Attesting Officer*

NICHOLAS P. GODICI
*Acting Director of the United States Patent and Trademark Office*